US006359269B1

(12) United States Patent
Hayasaki et al.

(10) Patent No.: US 6,359,269 B1
(45) Date of Patent: Mar. 19, 2002

(54) HEATING DEVICE, IMAGE FORMING APPARATUS, AND ELECTRIC-POWER CONTROL METHOD

(75) Inventors: Minoru Hayasaki; Hiroshi Mano, both of Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/626,384

(22) Filed: Jul. 26, 2000

(30) Foreign Application Priority Data

Jul. 30, 1999 (JP) ..... 11-217788

(51) Int. Cl.[7] ..... H05B 6/08; H05B 6/14; G03G 15/20

(52) U.S. Cl. ..... 219/665; 219/667; 219/668; 219/619; 399/328; 399/330

(58) Field of Search ..... 219/619, 663, 219/665, 667, 668; 399/328, 330, 335, 336

(56) References Cited

U.S. PATENT DOCUMENTS

| | | | | |
|---|---|---|---|---|
| 3,787,756 A | * | 1/1974 | Berger | 363/53 |
| 4,327,268 A | * | 4/1982 | Frank | 219/665 |
| 5,752,150 A | * | 5/1998 | Kato et al. | 399/330 |
| 5,801,359 A | | 9/1998 | Mano et al. | 219/667 |
| 5,819,150 A | | 10/1998 | Hayasaki et al. | 399/330 |
| 5,966,577 A | | 10/1999 | Abe | 399/320 |
| 6,037,576 A | * | 3/2000 | Okabayashi et al. | 219/619 |

FOREIGN PATENT DOCUMENTS

| | | |
|---|---|---|
| JP | 51-109739 | 9/1976 |
| JP | 63-313182 | 12/1988 |
| JP | 2-157878 | 6/1990 |
| JP | 4-44075 | 2/1992 |
| JP | 4-204980 | 7/1992 |

* cited by examiner

*Primary Examiner*—Philip H. Leung
(74) *Attorney, Agent, or Firm*—Fitzpatrick, Cella, Harper & Scinto

(57) ABSTRACT

A heating device for heating a material to be heated according to a magnetic-induction heating method includes a magnetic-field generator for generating a magnetic field, an electromagnetic-induction heating member for performing electromagnetic-induction heating by the magnetic field generated by the magnetic-field generator, a current detector for detecting a current flowing in the magnetic-field generator, a controller for controlling electric power supplied to the magnetic-field generator based on a result of detection of the current detector, and a current limiter for limiting a maximum current flowing in the magnetic-field generator based on the result of detection of the current detector.

20 Claims, 14 Drawing Sheets

HEATING DEVICE, IMAGE FORMING APPARATUS, AND ELECTRIC-POWER CONTROL METHOD

BACKGROUND OF THE INVENTION

1. Field of the Invention

The present invention relates to a heating device, an image forming apparatus, and an electric-power control method. More particularly, the invention relates to a heating device which is suitably applied to an electrophotographic apparatus, an electrostatic recording apparatus or the like which includes a heating device of a belt heating type as an image heating device, to an image forming apparatus, and to an electric-power control method.

2. Description of the Related Art

Conventionally, an image heating device (fixing device) is mounted in an image forming apparatus. A description will now be provided of a conventional image heating device (fixing device) which is mounted in an image forming apparatus, such as a copier, a printer or the like, and heats and fixes a toner image formed on a recording material.

In an image forming apparatus, such as a copier, a printer or the like, a heat-roller-type device has been widely used as a fixing device for heating and fixing an unfixed image (toner image) representing object image information formed and carried on a recording material (a transfer sheet, an Electrofax sheet, electrostatic recording paper, an OHP (overhead projector) sheet, printing paper, format paper or the like) according to image transfer or directly using means for an appropriate image forming process, such as an electrophotographic recording process, an electrostatic recording process, a magnetic recording process or the like, as a permanent fixed image on the surface of the recording material. Recently, heat-roller-type devices have been practically used from the viewpoint of quick starting and energy saving. Electromagnetic-induction-heating-type devices have also been proposed. Various types of fixing devices used in respective image forming apparatuses will now be described.

(a) Heat-roller-type Fixing Device

A heat-roller-type fixing device is basically configured by a pair of pressure-contact rollers, i.e., a fixing roller (heating roller) and a pressing roller. The pair of rollers are rotated, a recording material having an unfixed toner image to be fixed formed and carried thereon is guided into a fixing nip portion where the rollers are in pressure contact with each other and is grasped and conveyed at the fixing nip portion, and the unfixed toner image is fixed on the surface of the recording material by the heat of the fixing roller and the pressure at the fixing nip portion.

In general, the fixing roller includes a hollow metal roller made of aluminum as a base material (core), and a tungsten halogen lamp incorporated therein as a heat source. The fixing roller is heated by the heat of the tungsten halogen lamp, and the outer circumferential surface of the fixing roller is maintained at a predetermined fixing temperature by controlling current supply to the tungsten halogen lamp.

Particularly, a fixing device of an image forming apparatus for forming a full-color image, for which a capability of mixing toner images of four layers at maximum by sufficiently heating and fusing the images is required, includes a core having a high heat capacity, and a rubber elastic layer for uniformly fusing the toner images, provided at the outer circumferential surface of the core. The toner images are heated via the rubber elastic layer. In some fixing devices, a heat source is also provided within the pressing roller, and the pressing roller is heated and the temperature of the pressing roller is controlled.

However, in the heat-roller-type fixing device, even if the power supply of the image forming apparatus is turned on and power supply to the tungsten halogen lamp, serving as the heat source of the fixing device, is simultaneously started, a considerable time (a waiting time) is required until the temperature of the fixing roller reaches a predetermined fixable temperature from a completely cooled state, because the heat capacity of the fixing roller is large, resulting in an inferior quick starting property. In order to execute an image forming operation at any time even in a standby state (a non-image-output state) of the image forming apparatus, it is necessary to maintain the fixing roller at a predetermined temperature-control state by supplying power to the tungsten halogen lamp, resulting in large power consumption.

Particularly, when using a fixing roller having a large heat capacity, such as the fixing device of the above-described full-color image forming apparatus, since there is a delay until the temperature of the surface of the fixing roller reaches the temperature set by temperature control, problems such as insufficient fixing, unevenness in the gloss of the fixed image, offset and the like, arise.

(b) Film-heating-type Fixing Device

Film-heating-type fixing devices have been proposed, for example, in Japanese Patent Application Laid-Open (Kokai) Nos. 63-313182 (1988), 2-157878 (1990), 4-44075 (1992), and 4-204980 (1992).

That is, a nip portion is formed by inserting a heat-resisting film (fixing film) between a ceramic heater, serving as a heating member, and a pressing roller, serving as a pressing member. By introducing a recording material having an unfixed toner image to be fixed formed and carried thereon between the film and the pressing roller at the nip portion and grasping and conveying the recording material together with the film, the heat of the ceramic heater is given to the recording material via the film at the nip portion, and the unfixed toner image is fixed on the surface of the recording material by heat and pressure by the pressing force at the nip portion.

The film-heating-type fixing device has the advantages that, for example, an on-demand-type device can be provided by using low-heat-capacity members as the ceramic heater and the film, a state in which the device is heated to a predetermined fixing temperature may be provided by supplying power to the ceramic heater, serving as the heat source, only during image formation by the image forming apparatus, a waiting time from the turning-on of the power supply of the image forming apparatus to a state in which image formation can be executed is short (a quick starting property), and power consumption in a standby state is very small (power saving). However, the device of this type has a problem from the view point of the quantity of heat as a fixing device for a full-color image forming apparatus or a high-speed image forming apparatus requiring a large quantity of heat.

(c) Electromagnetic-induction-heating-type fixing device

Japanese Utility Model Application Laid-Open (Kokai) No. 51-109739 (1976) has disclosed an induction heating fixing device for heating a fixing roller by Joule heat generated by inducing current by a magnetic flux. This device can directly heat the fixing roller by utilizing the generation of an induction current, so that a fixing process having higher efficiency than the heat-roller-type fixing device using a tungsten halogen lamp as a heat source is achieved.

However, since the energy of an AC magnetic flux generated by an exciting coil, serving as magnetic-field generation means, is used for raising the temperature of the entire fixing roller, radiation loss is large. As a result, the ratio of the fixing energy to the input energy is low, thereby causing low efficiency.

Accordingly, high-efficiency fixing devices have been devised, for example, by reducing the distance between the exciting coil and the fixing roller, serving as a heating member, or concentrating the distribution of AC magnetic fluxes of the exciting coil in the vicinity of the fixing nip portion, in order to obtain high-density energy used for fixing.

A description will now be provided of the schematic configuration of an electromagnetic-induction-heating-type fixing device whose efficiency is improved by concentrating the distribution of AC magnetic fluxes of the exciting coil in the vicinity of the fixing nip, with reference to FIG. 2 which will be used in a first embodiment of the present invention. In FIG. 2, a cylindrical fixing film 10 serves as an electromagnetic-induction-heating rotating member having an electromagnetic-induction heating layer (including a conductive layer, a magnetic layer and a resistive layer). The cylindrical fixing film 10 is loosely fitted to the outer surfaces of gutter-shaped film guide members 16, each having a substantially semicircular cross section. Magnetic-field generation means 15 is disposed within the film guide members 16, and includes an exciting coil 18 and an E-shaped magnetic core 17. An elastic pressing roller 30 is in pressure contact with the lower surfaces of the film guide members 16 via the fixing film 10 while forming a fixing nip portion N having a predetermined width with a predetermined pressing force. The magnetic core 17 of the magnetic-field generation means 15 is disposed at a position corresponding to the fixing nip portion N.

The pressing roller 30 is rotatably driven in a counter-clockwise direction indicated by an arrow by driving means M. A rotational force operates on the fixing roller 10 due to a frictional force between the pressing roller 30 and the outer surface of the fixing film 10 caused by the rotatable driving of the pressing roller 30, so that the fixing film 10 is rotated along the film guide member 16 with a circumferential speed substantially corresponding to the rotational circumferential speed of the pressing roller 30 in a clockwise direction indicated by an arrow, while the inner surface of the fixing film 10 tightly contacts the lower surface of the film guide member 16 at the fixing nip portion N (a pressing-roller driving method). The film guide members 16 press against the fixing nip portion N, support the exciting coil 18 and the magnetic core 17 constituting the magnetic-field generation means 15, support the fixing film 10, and stabilize the conveyance of the fixing film 10 during its rotation. The film guide member 16 is an insulating member which does not hinder passage of a magnetic flux, and is made of a material which can endure a high load.

The exciting coil 18 generates an AC magnetic flux by an AC current supplied from an exciting circuit (not shown). The AC magnetic flux is distributed so as to concentrate on the fixing nip portion N by the E-shaped magnetic core 17 provided at a position corresponding to the fixing nip portion N, and generates an eddy current in the electromagnetic-induction heating layer of the fixing film 10. The eddy current generates a Joule heat in the electromagnetic-induction heating layer due to the specific resistance of the electromagnetic-induction heating layer. The electromagnetic-induction heat of the fixing film 10 is generated so as to concentrate on the fixing nip portion N where the AC magnetic field is concentrated, so that the fixing nip portion N is very efficiently heated. The temperature of the fixing nip portion N is maintained at a predetermined temperature by controlling current supply to the exciting coil 18 by a temperature control system including temperature detection means (not shown).

In a state in which the pressing roller 30 is rotatably driven, the cylindrical fixing film 10 is thereby rotated along the film guide members 16, and the temperature of the fixing nip portion N is raised to the predetermined temperature due to the electromagnetic-induction heating of the fixing film 10 as a result of current supply from the exciting circuit to the exciting coil 18 in the above-described manner, a recording material P having an unfixed toner image t formed thereon which has been conveyed from image forming means (not shown) is guided to the fixing nip portion P between the fixing film 10 and the pressing roller 30 in a state in which the image surface is placed upward, i.e., the image surface faces the surface of the fixing film 10, and is grasped and conveyed through the fixing nip portion N together with the fixing film 10 in a state in which the image surface tightly contacts the outer surface of the fixing film 10 at the fixing nip portion N. While the recording material P is grasped and conveyed through the fixing nip portion N together with the fixing film 10, the unfixed toner image t on the recording material P is fixed by being heated by the electromagnetic-induction heating of the fixing film 10. After passing through the fixing nip portion N, the recording material P is separated from the outer surface of the rotating fixing film 10, and is conveyed and discharged.

In the above-described conventional configuration, however, if electric power is supplied to the fixing unit in a state in which the induction heating coil (exciting coil) and the fixing film are cool, a large current flows in the circuit because the skin resistance due to the wire of the induction heating coil and the resistance of a metal constituting a sleeve, serving as a load, is small. Hence, a switching device allowing large current must be used, resulting in an increase in the production cost. Furthermore, as the temperatures of the induction heating coil and the sleeve rise, the current decreases due to an increase in the resistance caused by the temperature rise. As a result, it is impossible to stably supply the same electric power, and the rise time increases.

SUMMARY OF THE INVENTION

The present invention has been made in consideration of the above-described problems.

It is an object of the present invention to provide a heating device, an image forming apparatus and an electric-power control method which can maintain the maximum electric power to a constant value when heating a metal fixing film according to a magnetic-induction-heating fixing method, prevent reduction in output due to a temperature rise, realize higher-speed and more stable on-demand fixing, secure safety, and allow urgent stop of a heating fixing operation.

According to one aspect, the present invention which achieves the above-described object relates to a heating device for heating a material to be heated according to a magnetic-induction heating method, including magnetic-field generation means for generating a magnetic field, an electromagnetic-induction heating member for performing electromagnetic-induction heating by the magnetic field generated by the magnetic-field generation means, current detection means for detecting a current flowing in the magnetic-field generation means, control means for controlling electric power supplied to the magnetic-field generation means, based on a result of detection of the current detection means, and current limitation means for limiting a maximum current flowing in the magnetic-field generation means based on the result of detection of the current detection means.

If such a heating device is mounted in a copier or a printer for performing image formation by heating and fixing an unfixed image on a material to be heated as a permanent fixed image using a resonance-type power supply, since electric power is controlled using a signal from the current detection means, it is possible to maintain the maximum electric power to a constant value when heating electromagnetic-induction heating means (a metal fixing belt as a specific example) according to a magnetic-induction-heating fixing method, prevent reduction in output caused by a temperature rise, and realize higher-speed and more stable on-demand fixing.

It is preferable that the heating device further includes temperature detection means for detecting a temperature at a portion near a contact portion between the electromagnetic-induction heating member and the material to be heated, and that the control means controls supply of electric power to the magnetic-field generation means so that the temperature detected by the temperature detection means equals a specified temperature.

Accordingly, since supply of electric power to the magnetic-field generation means is stopped when the detected temperature of a contact portion between electromagnetic-induction heating means and pressing means exceeds the specified temperature, it is possible to secure safety of the fixing device from thermal runaway.

It is preferable that the heating device further includes urgent stop means for urgently stopping a heating operation by the electromagnetic-induction heating means based on an external input.

Accordingly, since a heating operation by the electromagnetic-induction heating means is urgently stopped based on an external input, it is possible to urgently stop a fixing operation in an emergency.

According to another aspect, the present invention which achieves the above-described object relates to an image forming apparatus including a heating device for heating a recording material by heat generated according to a magnetic-induction heating method. The heating device includes magnetic-field generation means for generating a magnetic field, an electromagnetic-induction heating means for heating the recording material by performing electromagnetic-induction heating by the magnetic field generated by the magnetic-field generation means, and pressing means for grasping the recording material between the electromagnetic-induction heating means and the pressing means in a state of pressure contact with the electromagnetic-induction heating means. Electric power supplied to the magnetic-field generation means is controlled based on a result of detection of a current flowing in the magnetic-field generation means.

According to still another aspect, the present invention which achieves the above-described object relates to an electric-power control method applied to a heating device for heating a material to be heated according to a magnetic-induction heating method. The heating device includes magnetic-field generation means for generating a magnetic field, electromagnetic-induction heating means for heating the material to be heated by performing electromagnetic-induction heating by the magnetic field generated by the magnetic-field generation means, and pressing means for grasping the material to be heated between the electromagnetic-induction heating means and the pressing means in a state of pressure contact with the electromagnetic-induction heating means. The method includes the step of controlling electric power supplied to the magnetic-field generation means based on a result of detection of a current flowing in the magnetic-field generation means.

The foregoing and other objects, advantages and features of the present invention will become more apparent from the following description of the preferred embodiments taken in conjunction with the accompanying drawings.

DESCRIPTION OF THE PREFERRED EMBODIMENTS

Preferred embodiments of the present invention will now be described in detail with reference to the drawings.

First Embodiment

In a first embodiment of the present invention, a description will be sequentially provided of a fixing device (heating device) mounted in an image forming apparatus, and an exciting coil, a fixing belt, a high-frequency inverter device, a current detection unit, temperature control, the voltage dependency of the maximum power, and a safety device in the fixing device.

Fixing Device (Heating Device)

A fixing device in the first embodiment is an electromagnetic-induction-heating-type device.

Figure 2:
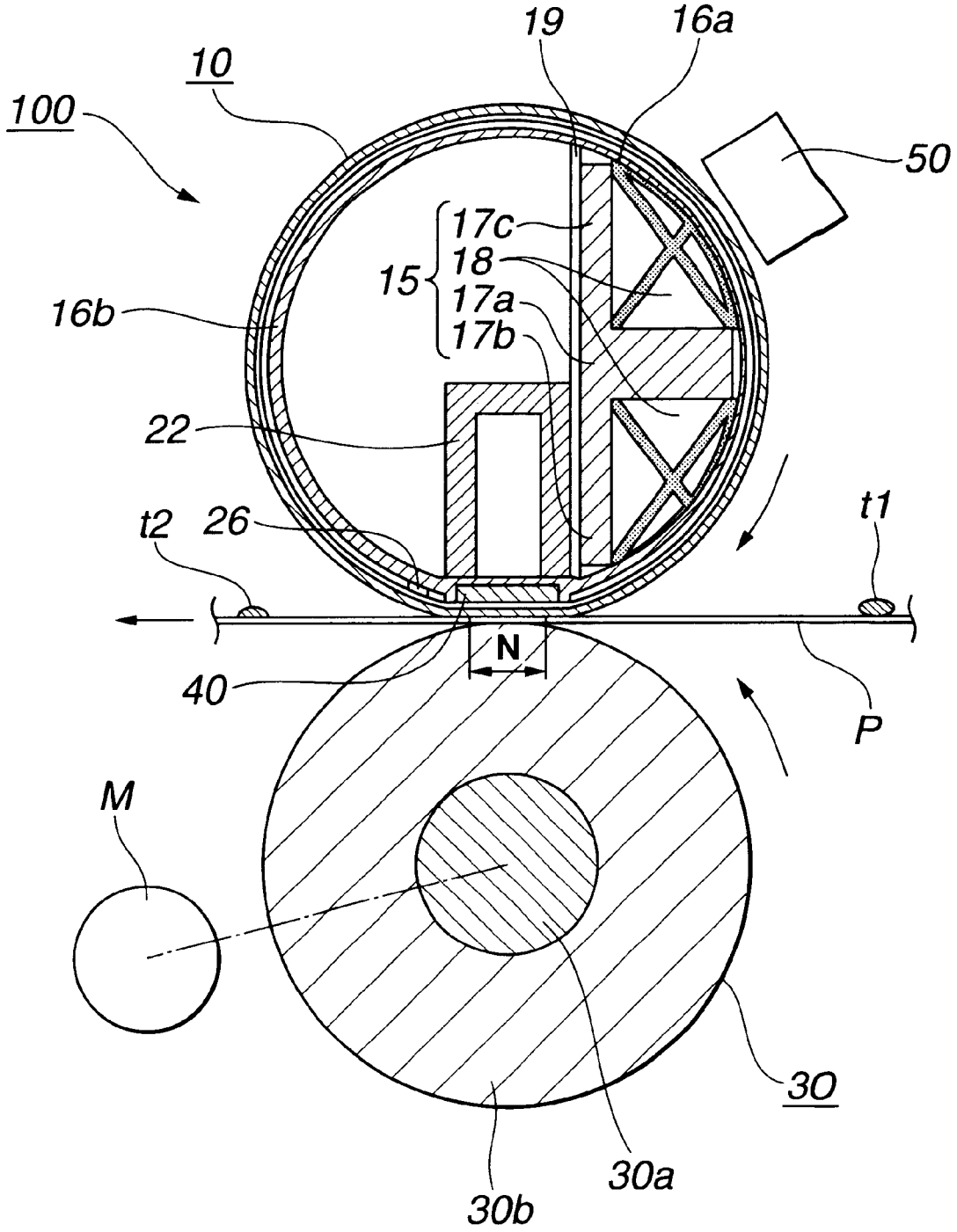
FIG. 2 is a cross-sectional view illustrating the structure of a principal portion of the fixing device of the image forming apparatus according to the first embodiment.
Figure 3:
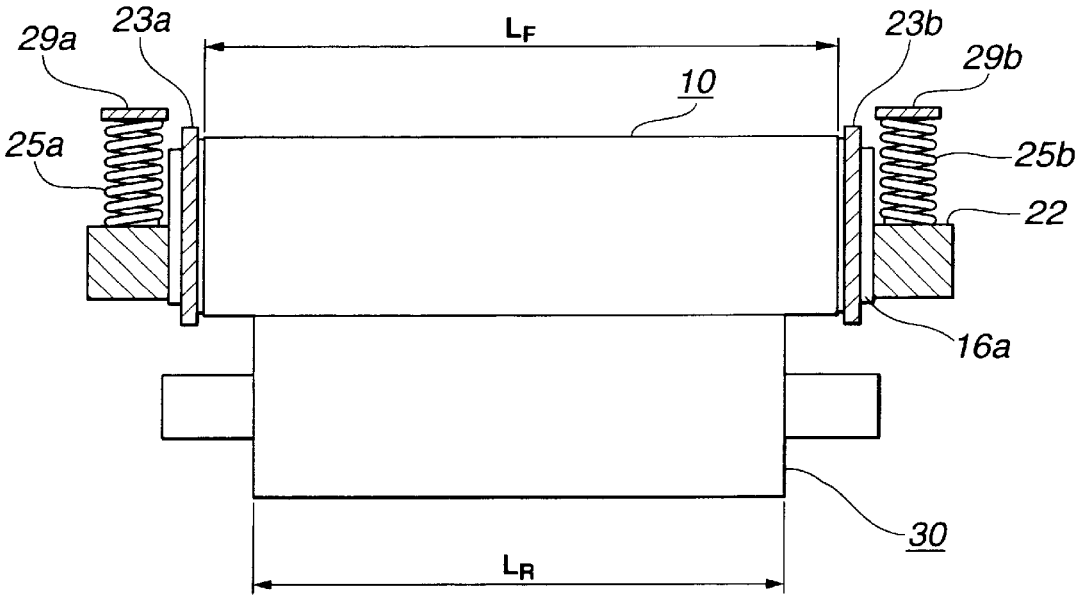
FIG. 3 is a partially cross-sectional view illustrating the frontal structure of the principal portion of the fixing device of the image forming apparatus according to the first embodiment.
Figure 4:
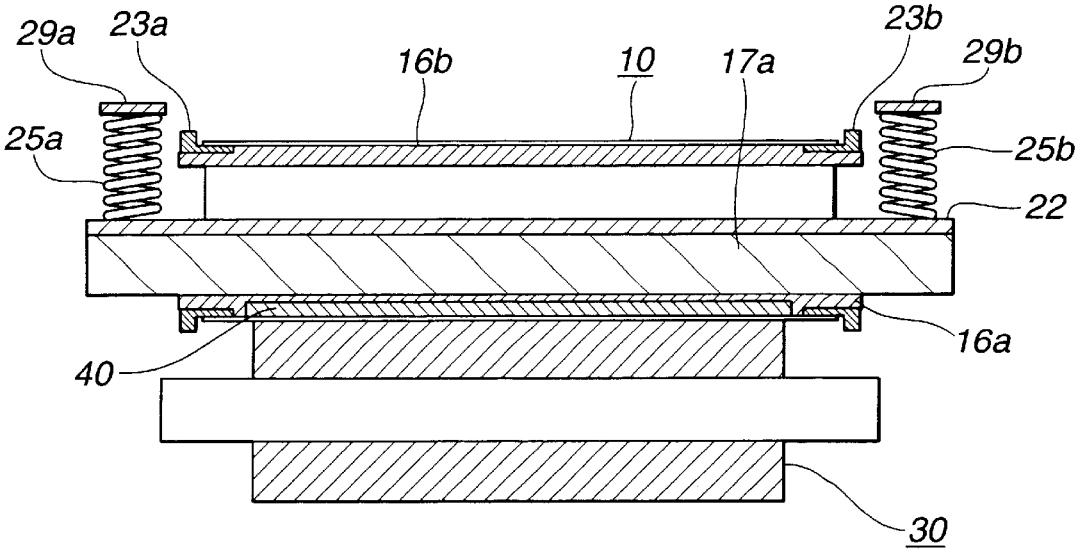
FIG. 4 is a cross-sectional view illustrating the frontal structure of the principal portion of the fixing device of the image forming apparatus according to the first embodiment.

FIG. 2 is a cross-sectional view illustrating the configuration of a principal portion of a fixing device 100 according to the first embodiment. FIG. 3 is a diagram illustrating the frontal structure of the principal portion of the fixing device 100. FIG. 4 is a cross-sectional view illustrating the configuration of the principal portion of the fixing device 100. A description will be omitted or simplified for portions common to the portions described in the foregoing conventional example.

In the configuration of the principal portion of the fixing device 100, magnetic-field generation means includes magnetic cores 17*a*, 17*b* and 17*c*, and an exciting coil 18. The magnetic cores 17*a*, 17*b* and 17*c* are made of a high-permeability material, which may be a material used for a core of a transformer, such as ferrite, permalloy or the like, and more preferably, a ferrite whose loss is small even at frequencies equal or higher than 100 kHz. An excitation circuit 27 (see FIG. 5) is connected to feeding portions 18*a* and 18*b* of the exciting coil 18. The excitation circuit 27 can generate a high-frequency signal between 20 kHz and 500 kHz using a switching power supply. The exciting coil 18 generates an AC magnetic flux by an AC current (high-frequency current) supplied from the excitation circuit 27. Belt guide members 16*a* and 16*b* are gutter-shaped members, each having a substantially semicircular cross section, and constitute a substantially cylindrical member. A fixing belt 10, serving as a circular in, electromagnetic-induction heating belt, is loosely fitted to the outside of the belt guide members 16*a* and 16*b*. The belt guide member 16*a* incorporates the magnetic cores 17*a*, 17*b* and 17*c*, and the exciting coil 18 which constitute the magnetic-field generation means. The belt guide member 16*a* includes a heat-conductive member 40 extending in a direction perpendicular to the surface of FIG. 2, disposed on a surface facing a pressing roller 30 at a nip portion N and within the fixing belt 10, as shown in FIG. 4. In the first embodiment, the heat-conductive member 40 is made of aluminum, and has a thermal conductivity k of 240 $W \cdot m^{-1} \cdot K^{-1}$, and a thickness of 1 mm.

In order to be not influenced by the magnetic field generated by the exciting coil 18 and the magnetic cores 17*a*, 17*b* and 17*c* which constitute the magnetic-field generation means, the heat-conductive member 40 is disposed at the outside of the magnetic field. More specifically, the heat-conductive member 40 is disposed at a position separated from the exciting coil 18 via the magnetic core 17*c*, i.e., at the outside of the magnetic field generated by the exciting coil 18. A pressing rigid stay 22 is a laterally-long stay disposed in contact with the inner flat portion of the belt guide member 16*b*. An insulating member 19 is a member for insulating the pressing rigid stay 22 from the magnetic cores 17*a*, 17*b* and 17*c*, and the exciting coil 18. Flange members 23*a* and 23*b* are externally fitted to both end portions of the assembly of the belt guide members 16*a* and 16*b* so as to be rotatable while fixing the both end portions, in order to regulate the movement of the fixing belt 10 in a longitudinal direction of the belt guide members 16*a* and 16*b* during rotation of the fixing belt 10.

The pressing roller 30, serving as a pressing member, includes a core 30*a*, and a heat-resisting elastic layer 30*b*, made of a silicone rubber, a fluororesin or the like, coaxially formed around the core 30*a* in the form of a roller. Both end portions of the core 30*a* are rotatably supported by bearings between chassis-side plates (not shown) of the apparatus. By providing pressing springs 25*a* and 25*b* between both end portions of the pressing rigid stay 22 and spring brackets 29*a* and 29*b*, respectively, a pressing-down force is applied to the pressing rigid stay 22. Thus, the lower surface of the belt guide member 16*a* and the upper surface of the pressing roller 30 are in pressure contact via the fixing belt 10, to form the fixing nip portion N having a predetermined width.

The pressing roller 30 is rotatably driven in a counter-clockwise direction indicated by an arrow by driving means M. A rotational force operates on the fixing belt 10 due to a frictional force between the pressing roller 30 and the outer surface of the fixing belt 10 caused by the rotatable driving of the pressing roller 30, so that the fixing belt 10 rotates along the heat conductive member 40 with a circumferential speed substantially corresponding to the rotational circumferential speed of the pressing roller 30 in a clockwise direction indicated by an arrow, while the inner surface of the fixing belt 10 tightly contacts the lower surface of the heat conductive member 40 at the fixing nip portion N.

In this case, in order to reduce the frictional force between the lower surface of the heat conductive member 40 and the inner surface of the fixing belt 10 at the fixing nip portion N, a lubricant, such as heat-resisting grease or the like, is applied between the lower surface of the heat conductive member 40 and the inner surface of the fixing belt 10 at the fixing nip portion N. Alternatively, the lower surface of the heat conductive member 40 may be coated with a lubricating member, in order to prevent degradation in the durability of the sliding fixing belt 10 by being damaged, when the surface of the heat conductive member 40 does not slide well as in the case of using aluminum for the heat conductive member 40, or when the finishing of the heat conductive member 40 is not sufficiently perfored.

Figure 5:
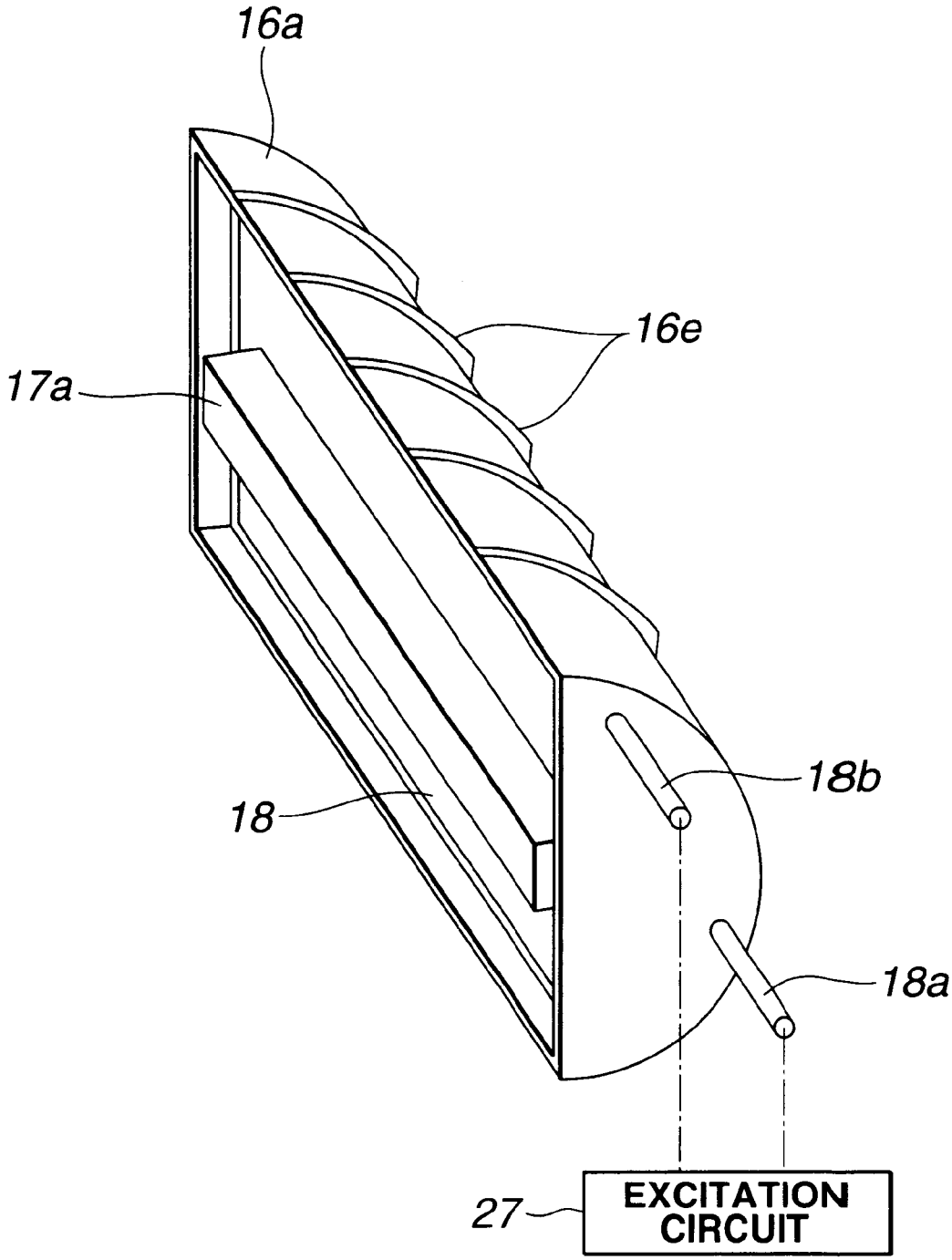
FIG. 5 is a perspective view illustrating a belt guide member, an exciting coil and the like which constitute the fixing device of the image forming apparatus according to the first embodiment.

The heat conductive member 40 has the effect of making the temperature distribution in the longitudinal direction uniform. For example, when passing a small-size sheet through the fixing nip portion N, the quantity of heat at a portion where the sheet does not pass is transmitted to the heat conductive member 40, and is further transmitted to a portion where the small-size sheet passes, due to heat conduction in the longitudinal direction of the heat conductive member 40. Thus, power consumption when passing a small-size sheet can be reduced. As shown in FIG. 5, convex rib portions 16e are formed on the circumferential surface of the belt guide member 16*a* with a predetermined interval in the longitudinal direction, in order to reduce the contact sliding resistance between the circumferential surface of the belt guide member 16*a* and the inner surface of the fixing belt 10, and thereby reduce the rotational load of the fixing belt 10. Such convex rib members may also be formed on the belt guide member 16*b*.

Figure 6:
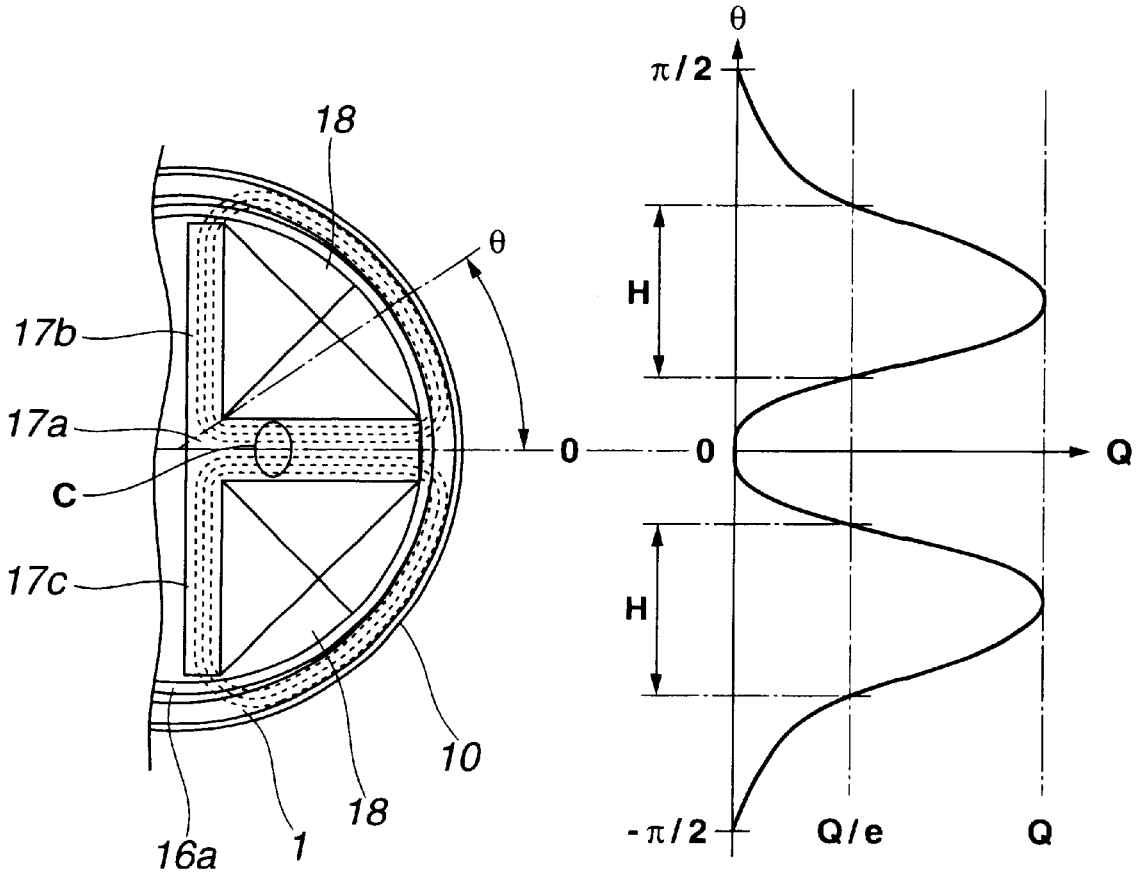
FIG. 6 is a diagram illustrating how magnetic fluxes are generated in a fixing belt and the like of the fixing device of the image forming apparatus according to the first embodiment.

FIG. 6 is a schematic diagram illustrating how AC magnetic fluxes are generated. A magnetic flux C represents a part of the generated AC magnetic fluxes. The AC magnetic flux C guided to the magnetic cores 17*a*, 17*b* and 17*c* generates an eddy current in an electromagnetic-induction heating layer 1 of the fixing belt 10 at portions between the magnetic cores 17*a* and 17*b* and between the magnetic cores 17*a* and 17*c*. This eddy current generates a Joule heat (eddy-current loss) in the electromagnetic-induction heating layer 1 due to the specific resistance of the electromagnetic-induction heating layer 1. The calorific value Q at that time is determined by the magnetic flux density passing through the electromagnetic-induction heating layer 1, and has a distribution as indicated by a graph at the right side of FIG. 6. In the graph at the right side of FIG. 6, the ordinate represents a position on the fixing belt 10 in a circumferential direction represented by an angle θ making the center of the magnetic core 17*a* 0, and the abscissa represents the calorific value Q in the electromagnetic-induction heating layer 1 of the fixing belt 10. A heated region H is defined as a region where the caloric value is at least Q/e, where Q is the maximum calorific value. This amount is an amount necessary for fixing.

The temperature of the fixing nip portion N is maintained at a predetermined temperature by controlling current supply to the exciting coil 18 by a temperature control system including temperature detection means (not shown). Reference numeral 26 in FIG. 2 represents a temperature sensor, such as a thermistor or the like, for detecting the temperature of the fixing belt 10. In the first embodiment, the temperature of the fixing nip portion N is controlled based on temperature information relating to the fixing belt 10 measured by the temperature sensor 26.

In a state in which the fixing belt 10 rotates, and the temperature of the fixing nip portion N is raised to the predetermined temperature and then subjected to temperature control by the electromagnetic-induction heating of the fixing belt 10 as a result of current supply from the exciting circuit 27 to the exciting coil 18 in the above-described manner, a recording material P, serving as a material to be heated, having the unfixed toner image t formed thereon which has been conveyed from image forming means is guided to the fixing nip portion N between the fixing belt 10 and the pressing roller 30 in a state in which the image surface is placed upward, i.e., the image surface faces the surface of the fixing belt 10, and is grasped and conveyed through the fixing nip portion N together with the fixing belt 10 in a state in which the image surface tightly contacts the outer surface of the fixing belt 10. In this process, the unfixed toner image t on the recording material P is fixed by being heated by the electromagnetic-induction heating of the fixing belt 10. After passing through the fixing nip portion N, the recording material P is separated from the outer surface of the rotating fixing belt 10, and is conveyed and discharged. After passing through the fixing nip portion N, the heated fixed toner image on the recording material P is cooled to provide a permanent fixed image.

In the first embodiment, as shown in FIG. 2, a thermoswitch 50, serving as a temperature detector, is disposed at a position facing the heated region H (see FIG. 6) of the fixing belt 10, in order to interrupt power supply to the exciting coil 18 during runaway.

Figure 7:
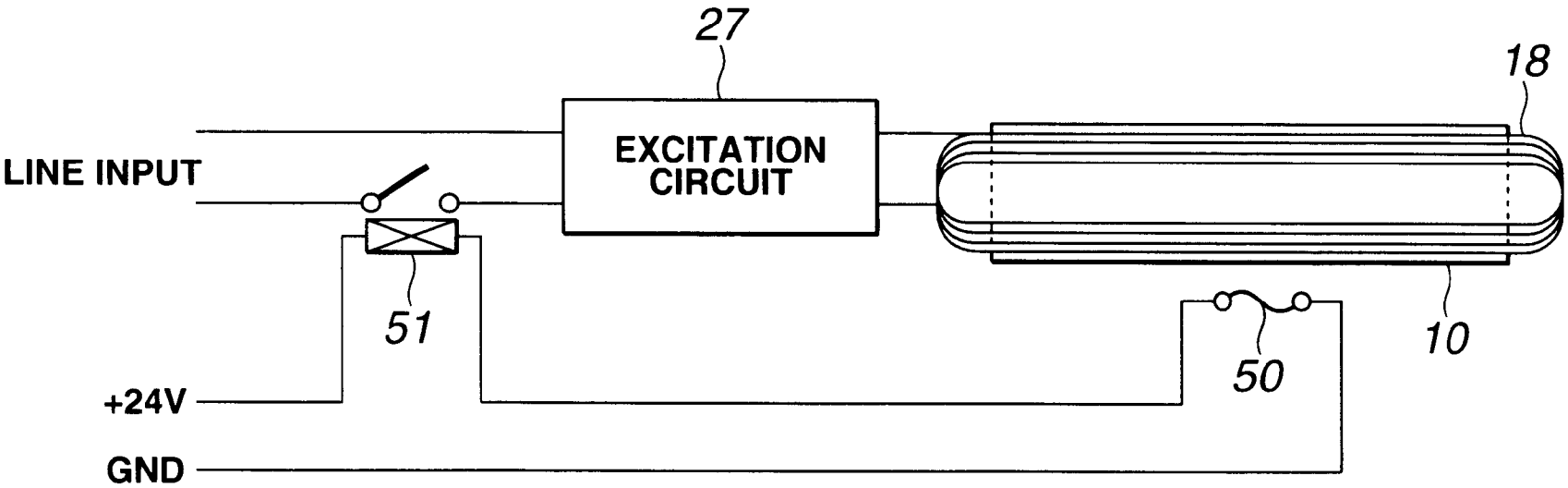
FIG. 7 is a circuit diagram illustrating a safety circuit of the fixing device of the image forming apparatus according to the first embodiment.

FIG. 7 is a circuit diagram of a safety circuit used in the first embodiment. The thermoswitch 50, serving as the temperature detector, is connected in series with a +24 V DC power supply and a relay -switch 51. When the thermoswitch 50 is disconnected, power supply to the relay switch 51 is interrupted, to operate the relay switch 51 and thereby disconnect power supply to the exciting circuit 27, as well as power supply to the exciting coil 18. The off-operation temperature of the thermoswitch 50 is set to 220° C. The thermoswitch 50 is disposed so as to face the heated region H of the fixing belt (film) 10 in a state of not contacting the outer surface of the fixing belt 10. The distance between the thermoswitch 50 and the fixing belt 10 is about 2 mm. Thus, it is possible to prevent the fixing belt 10 from being damaged by contacting the thermoswitch 50, and degradation in the fixed image after repeated fixing operations.

According to the first embodiment, in contrast to the conventional configuration in which the fixing nip portion N is heated during runaway of the fixing device due to a failure in the device, the fixing device stops its operation in a state in which a sheet is inserted in the fixing nip portion N. Accordingly, even if the fixing belt 10 continues to be heated as a result of power supply to the exciting coil 18, the sheet is not directly heated because the fixing nip portion N having the sheet inserted therein is not heated. Furthermore, since the thermoswitch 50 is disposed at the heated region H having a large calorific value, power supply to the exciting coil 18 is interrupted by the relay switch 51 when the thermoswitch 50 is disconnected as a result of detection of 220° C. by the thermoswitch 50. In the first embodiment, since the ignition temperature of paper is about 400° C., the paper is not ignited, and the fixing belt 10 can be prevented from being heated.

A temperature fuse may also be used as the temperature detector instead of the thermoswitch. In the first embodiment, since a toner containing a material having a low softening point is used, an oil coating mechanism for preventing offset is not provided in the fixing device. When using a toner not containing a material having a low softening point, an oil coating mechanism may be provided. Even if a toner containing a material having a low softening point, oil coating or separation by cooling may be performed.

Exciting Coil

The exciting coil 18 is formed by winding a bundle of a plurality of copper fine wires (a bundle wire), each having insulating coating, a plurality of times. In consideration of conduction of heat generated by the fixing belt 10, heat-resisting insulating coating may be used. For example, amide imide or polyimide coating may be used. The degree of tightness of the exciting coil 18 may be improved by applying pressure from the outside.

As shown in FIG. 2, the shape of the exciting coil 18 is arranged so as to follow the curved surface of the heating layer. In the first embodiment, the distance between the heating layer of the fixing belt 10 and the exciting coil 18 is about 2 mm. An insulating and heat-resisting material may be used for an exciting-coil holding member 19. For example, a phenol resin, a fluororesin, a polyimide resin, a polyamide resin, a polyamide imide resin, a PEEK resin, a PES resin, a PPS resin, a PFA resin, a PTFE (polytetrafluroethylene) resin, an FEP resin, an LCP resin or the like may be used as the material.

The absorption efficiency of the magnetic flux is higher as the distance between the magnetic cores 17*a*, 17*b* and 17*c* and the exciting coil 18, and the heating layer of the fixing belt 10 is shorter. If the distance exceeds 5 mm, the efficiency is greatly degraded. Hence, the distance is preferably equal to or less than 5 mm. If the distance is within 5 mm, the distance between the heating layer of the fixing belt 10 and the exciting coil 18 need not be constant. Lead wires 18*a* and 18*b* (see FIG. 5) from the exciting-coil holding member 19 of the exciting coil 18 have insulating coating thereon at portions out of the exciting-coil holding member 19.

Fixing Belt

Figure 8:
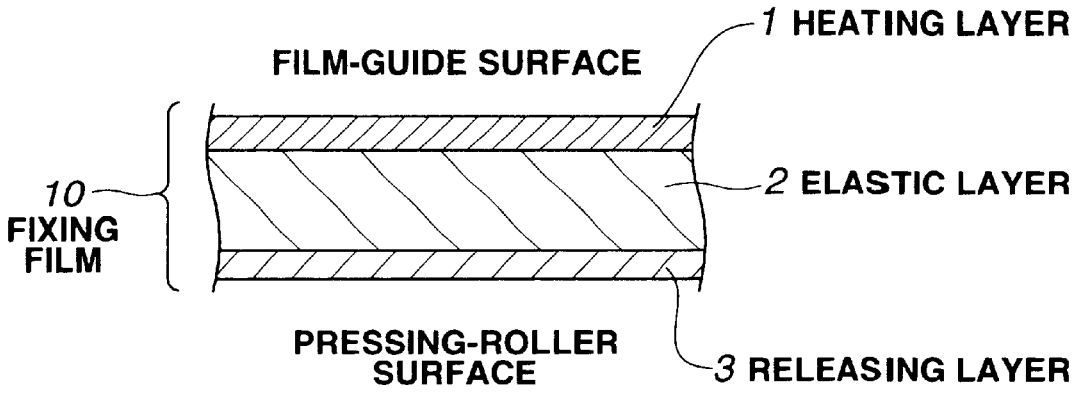
FIG. 8 is a schematic cross-sectional view illustrating a configuration of layers of the fixing belt of the fixing device of the image forming apparatus according to the first embodiment.

FIG. 8 is a diagram illustrating the configuration of layers on the a fixing belt 10 in the first embodiment. The fixing belt 10 has a composite structure including a heating layer 1, configured, for example, by a metal belt, serving as a base layer of the electromagnetic-induction-heating-type fixing belt 10, an elastic layer 2 laminated on the outer surface of the heating layer 1, and a releasing layer 3 laminated on the outer surface of the elastic layer 2. For the purpose of bonding between the heating layer 1 and the elastic layer 2, and bonding between the elastic layer 2 and the releasing layer 3, a primer layer (not shown) may be provided between the respective layers. In the fixing belt 10 having a substantially cylindrical shape, the heating layer 1 is at the inner surface side, and the releasing layer 3 is at the outer surface side. As described above, by providing the heating layer 1 with an AC magnetic flux, an eddy current is generated in the heating layer 1 to heat the heating layer 1. The generated heat heats the fixing belt 10 via the elastic layer 2 and the releasing layer 3, and also heats the recording material P, serving as the material to be heated, passing through the fixing nip portion N, to fix the toner image on the recording material P.

(a) Heating Layer 1

The heating layer 1 may be made of a ferromagnetic metal, such as nickel, iron, ferromagnetic SUS (stainless steel), or a nickel-cobalt alloy. Although a nonmagnetic metal may also be used, it is preferable to use a metal which well absorbs a magnetic flux, such as nickel, iron, magnetic stainless steel, a cobalt-nickel alloy or the like. The thickness of the metal is preferably equal to or larger than the skin depth expressed by the following equation and equal to or less than 200 $\mu$m. The skin depth $\sigma$ (m) is represented by $\sigma=503\times(\rho/f\mu)^{1/2}$, where f (Hz) is the frequency of the exciting circuit 27, $\mu$ is permeability, and $\rho$ ($\Omega$m) is resistivity.

Figure 10:
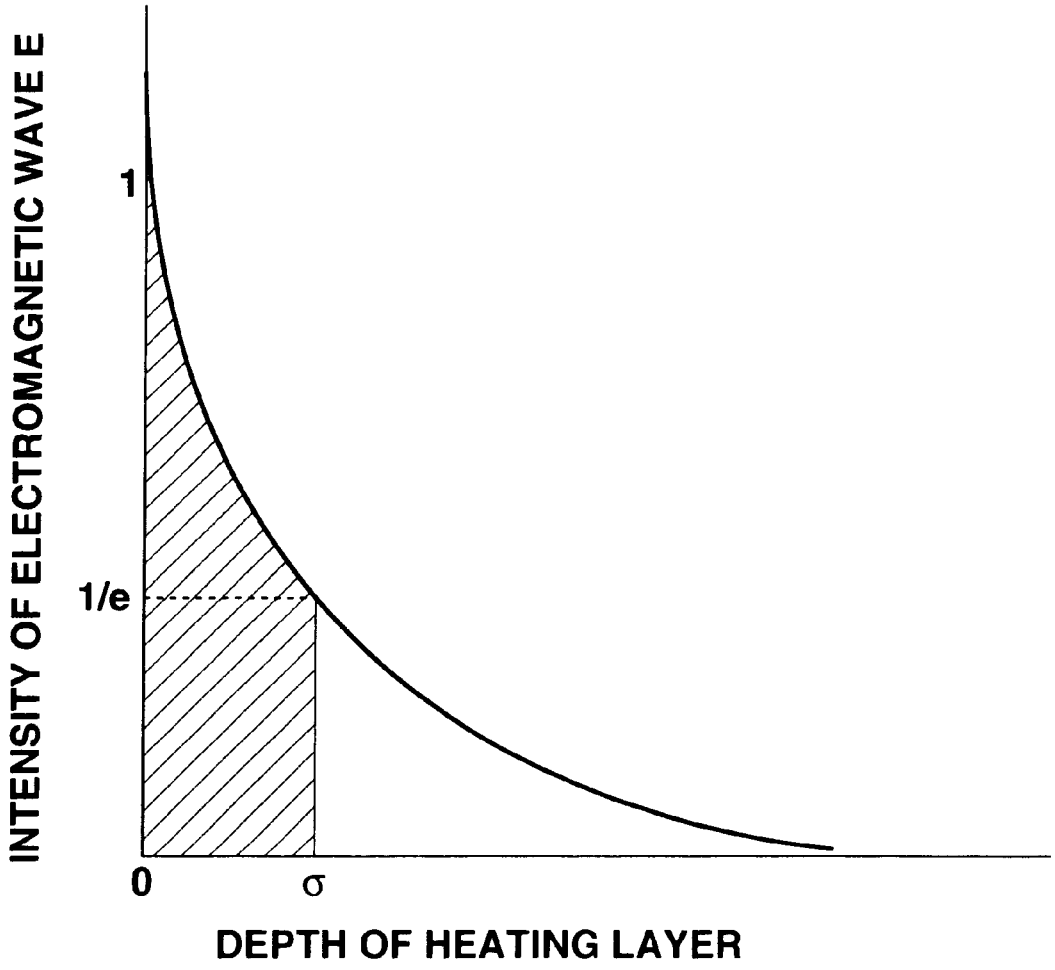
FIG. 10 is a diagram illustrating the relationship between the intensity of an electromagnetic wave and the depth of a heating layer in the first embodiment.

The skin depth indicates the depth of absorption of the electromagnetic wave used in electromagnetic induction. The intensity of the electromagnetic wave is equal to or less than 1/e at a depth equal to or more than the skin depth. In other words, almost all energy is absorbed within this depth (see FIG. 10). The thickness of the heating layer 1 is preferably 1–100 $\mu$m. If the thickness of the heating layer 1 is less than 1 $\mu$m, almost all electromagnetic energy is not absorbed, resulting in inferior efficiency. If the thickness of the heating layer 1 exceeds 100 $\mu$m, the rigidity becomes too high and the bending property is degraded. Hence, it is not realistic to use such a layer for a rotating member. Accordingly, the thickness of the heating layer 1 is preferably 1–100 $\mu$m.

(b) Elastic Layer 2

The elastic layer 2 may be made of a heat-resisting and heat-conductive material, such as a silicone rubber, a fluororubber, a fluorosilicone rubber or the like. The thickness of the elastic layer 2 is preferably 10–500 $\mu$m, which is a thickness necessary to guarantee the quality of the fixed image. When printing a color image, particularly a photograph image or the like, a solid image is formed over a large area on the recording material P. In this case, if the heating surface (the releasing layer 3) cannot follow projections and recesses on the recording material P or the toner layer, unevenness in heating occurs, thereby generating unevenness in gloss occurs between portions having large amounts of heat transfer and portions having small amounts of heat transfer in the image. Glossiness is high at portions having large amounts of heat transfer, and glossiness is low at portions having small amounts of heat transfer. If the thickness of the elastic layer 2 is equal to or less than 10 $\mu$m, the heating surface cannot follow projections and recesses on the recording material or the toner layer, thereby generating unevenness in the gloss of the image. If the thickness of the elastic layer 2 is equal to or more than 1,000 $\mu$m, the thermal resistance of the elastic layer 2 is too large, and it is difficult to realize quick start. More preferably, the thickness of the elastic layer 2 is 50–500 $\mu$m.

If the hardness of the elastic layer 2 is too large, the heating surface cannot follow projections and recesses on the recording material or the toner layer, thereby generating unevenness in the gloss of the image. Accordingly, the hardness of the elastic layer 2 is preferably equal to or less than 60 degrees (JIS(Japanese Industrial Standards)-A), and more preferably, equal to or less than 45 degrees (JIS-A). The thermal conductivity $\lambda$ of the elastic layer 2 is preferably $6\times10^{-4}$–$2\times10^{-3}$ cal/cm·sec·deg.

If the thermal conductivity A is smaller than $6\times10^{-4}$ cal/cm·sec·deg, the heat resistance is large, and the temperature rise in the surface layer (the releasing layer 3) of the fixing belt 10 is slow.

If the thermal conductivity $\lambda$ is larger than $2\times10^{-3}$ cal/cm·sec·deg, the hardness becomes too large and the compression set increases.

Accordingly, the thermal conductivity $\lambda$ is preferably $6\times10^{-4}$–$2\times10^{-3}$ cal/cm·sec·deg, and more preferably, $8\times10^{-4}$–$1.5\times10^{-3}$ cal/cm·sec·deg.

(c) Releasing Layer 3

The releasing layer 3 may be made of a material having an excellent releasing property and a high heat-resisting property, such as a fluororesin, a silicone resin, a fluorosilicone resin, a fluororubber, a silicone rubber, PFA, PTFE, FEP or the like. The thickness of the releasing layer 3 is preferably 1–100 $\mu$m. If the-thickness of the releasing layer 3 is less than 1 $\mu$m, problems arise such that, for example, portions having a poor releasing property are provided due to unevenness in coating, and durability is insufficient. If the thickness of the releasing layer 3 exceeds 100 $\mu$m, a poor heat conducting property is provided. Particularly in the case of a resin-type releasing layer, the hardness becomes too large, and the effect of the elastic layer 2 disappears.

Figure 9:
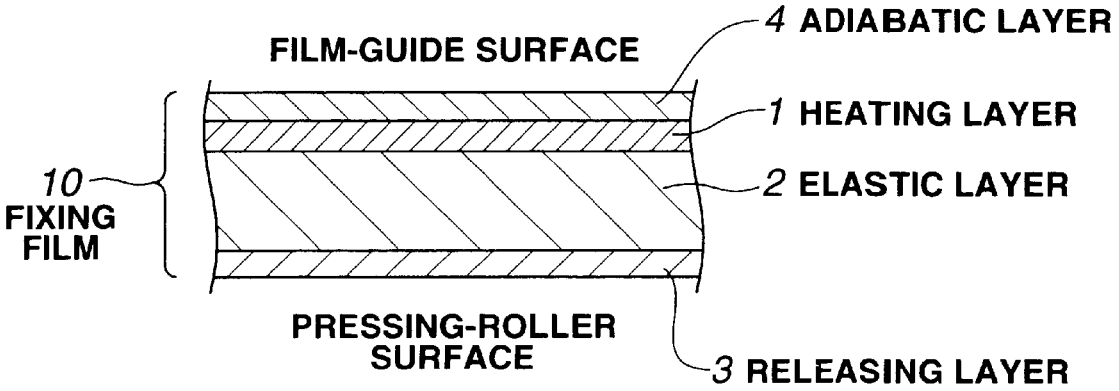
FIG. 9 is a schematic cross-sectional view illustrating another configuration of layers of the fixing belt of the fixing device of the image forming apparatus according to the first embodiment.

As shown in FIG. 9, in the configuration of the fixing belt (fixing film) 10, an adiabatic layer 4 may be provided at the belt guide surface side of the heating layer 1 (a surface of the heating layer 1 opposite to the elastic layer 2). The adiabatic layer 4 may be made of an adiabatic resin, such as a fluororesin, a polyimide resin, a polyamide resin, a polyamide imide resin, a PEEK resin, a PES resin, a PPS resin, a PFA resin, a PTFE resin, an FEP resin or the like.

The thickness of the adiabatic layer 4 is preferably 10–100 $\mu$m. If the thickness of the adiabatic layer 4 is less than 10 $\mu$m, the adiabatic effect is not obtained, and durability is insufficient. On the other hand, if the thickness of the adiabatic layer 4 exceeds 100 $\mu$m, the distance between the magnetic cores 17*a*, 17*b* and 17*c* and the exciting coil 18, and the heating layer 1 becomes large, so that the magnetic flux is not sufficiently absorbed in the heating layer 1. Since the adiabatic layer 4 can prevent the heat generated in the heating layer 1 from going to the inside of the fixing belt 10, the efficiency of heat supply to the recording material P is improved than in the case of not providing the adiabatic layer 4. As a result, electric power consumption can be suppressed.

High-frequency Inverter Device

Figure 1:
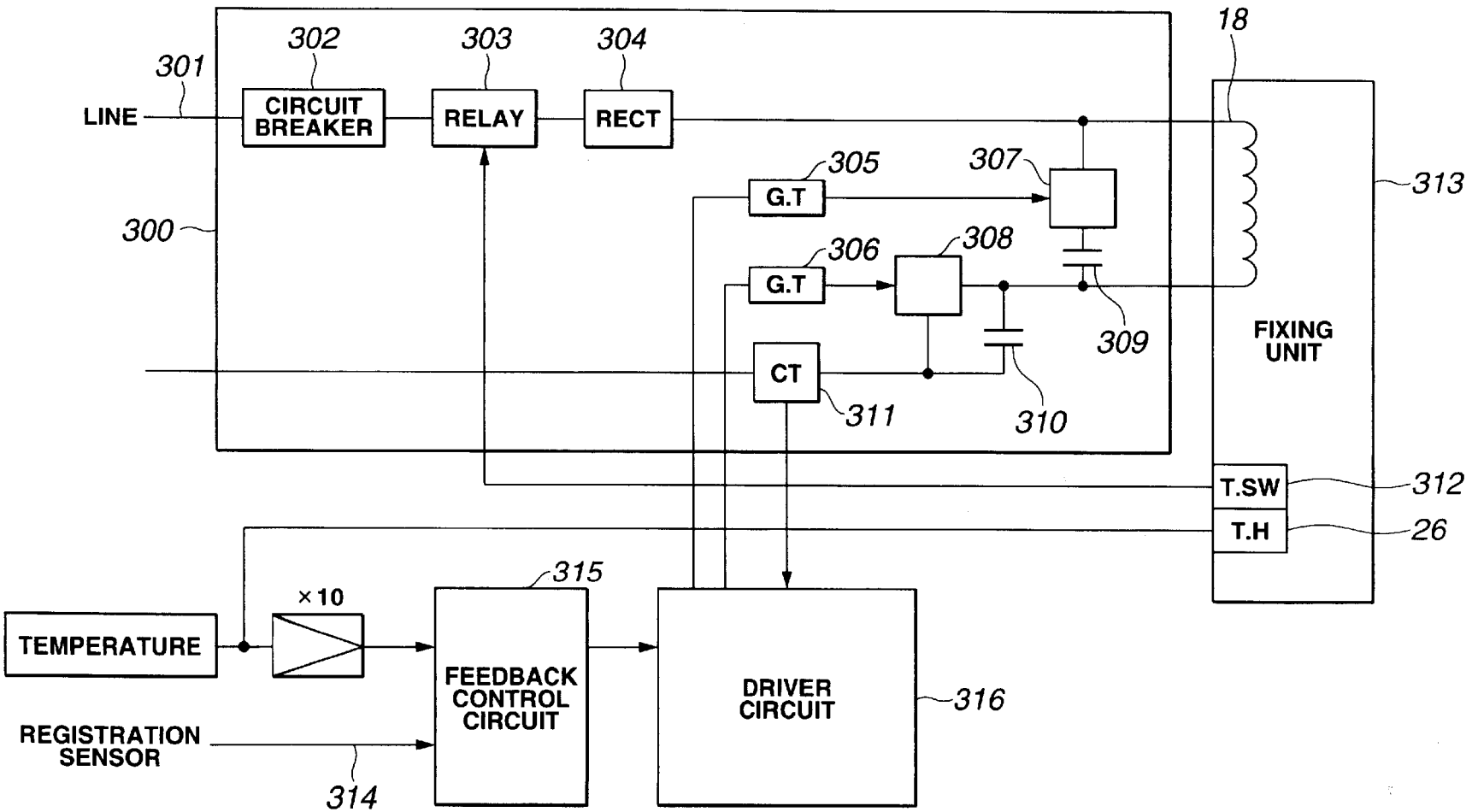
FIG. 1 is a diagram illustrating the configuration of an induction-heating control unit of a fixing device of an image forming apparatus according to a first embodiment of the present invention.
Figure 12:
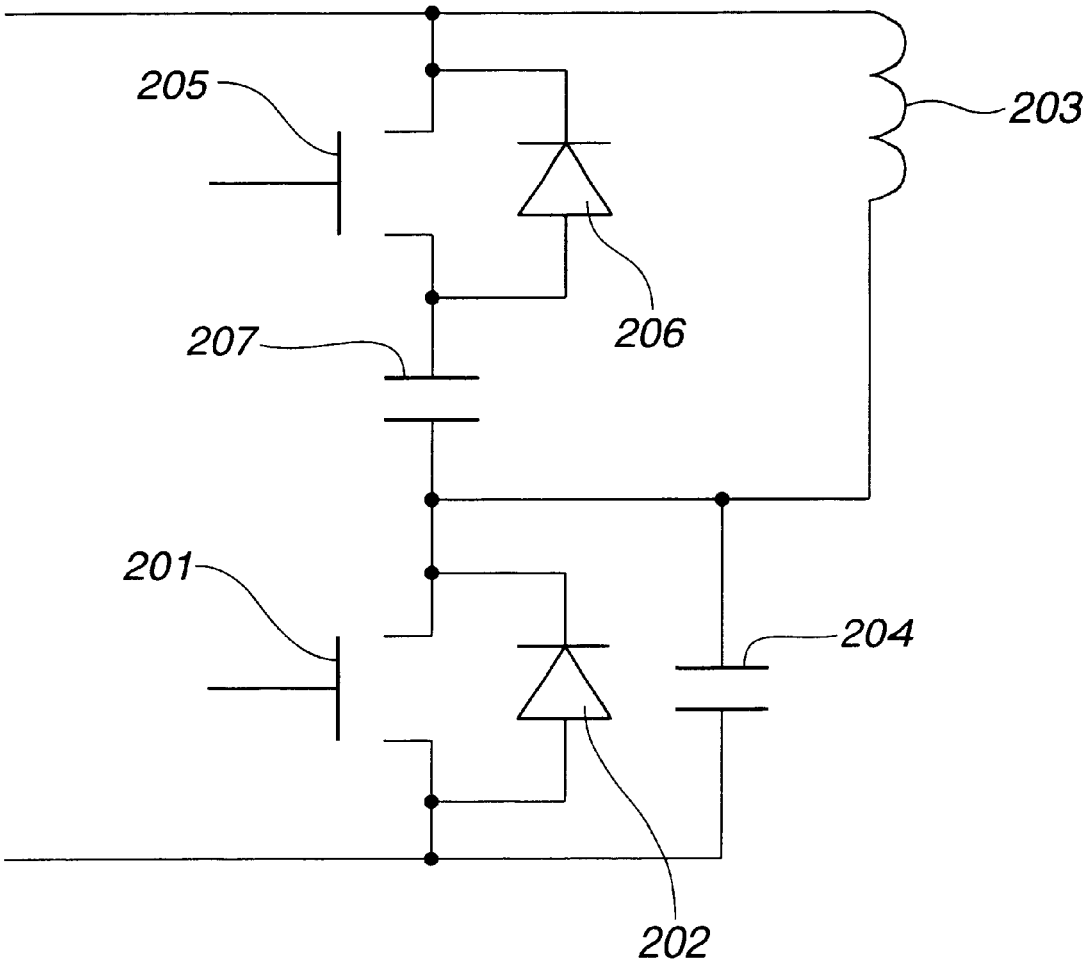
FIG. 12 is a circuit diagram illustrating the configuration of an output converter of the fixing device of the image forming apparatus according to the first embodiment.

FIG. 1 is a block diagram illustrating the entire configuration of an induction-heating control unit including an output converter shown in FIG. 12 (to be described later) in the image forming apparatus according to the first embodiment. The induction-heating control unit of the image forming apparatus according to the first embodiment includes a voltage control circuit 300, a fixing unit (fuser) 313, a feedback control circuit 315, and a driver circuit 316. The voltage control circuit 300 includes a circuit breaker 302, a relay 303, a rectification circuit 304, gate control transformers 305 and 306, a main switching device 307, a second switching device 308, a resonant capacitor 309, a second resonant capacitor 310, and a current transformer 311. There are also shown a power-supply-line input terminal 301, and a terminal 314 for inputting a signal for turning on/off the fixing device.

The configuration and the operation of the above-described principal components will now be described in detail. The circuit breaker 302 protects the unit from excess current. The rectification circuit 304 includes a bridge rectification circuit for performing full-wave rectification of an AC input, and a capacitor for performing high-frequency filtering. The main switching device 307 and the second switching device 308 perform switching of current. The current transformer 311 detects a switching current as a result of switching by the main switching device 307 and the second switching device 308. The fixing unit 313 includes the exciting coil 18 (see FIG. 2) and the temperature detection thermistor 26 (see FIG. 2) which have been described above, and a thermoswitch 312 for detecting excessive temperature rise. The input terminal 314 controls on/off of output of the high-frequency inverter device using a voltage signal transmitted from a printer sequence controller (not shown) of the image forming apparatus.

The feedback control circuit 315 controls the temperature of the fixing device by comparing the detection value of the thermistor of the fixing device with a target temperature. The driver circuit 316 performs control conforming to the method of control of the high-frequency inverter device by receiving a feedback control signal from the feedback control circuit 315. A power switching device, such as an FET (field-effect transistor) or an IGBT (insulated gate bipolar transistor) (plus a reverse conducting diode), is most suitable as each of the main switching device 307 and the second switching device 308. In order to control a resonant current, a device having a low loss during a stationary state, a low switching loss, a high breakdown voltage, and a large current is preferable as each of the main switching device 307 and the second switching device 308.

When electric power from an AC input power supply is input to the power-supply-line input terminal 301, and is supplied to the rectification circuit 304 via the circuit breaker 302 and the relay 303, a pulsating DC voltage is generated by full-wave rectifying diodes of the rectification circuit 304. Then, by driving the gate control transformer 305 so as to cause the main switching device 307 to perform switching, an AC pulse voltage is applied to a resonant circuit configured by the exciting coil 18 and the resonant capacitor 309. As a result, while the second switching device 308 is in a conducted state, the pulsating DC voltage is applied to the exciting coil 18, so that a current determined by the inductance and the resistance of the exciting coil 18 starts to flow. When the second switching device 308 is turned off by a gate signal, since the exciting coil 18 intends to continue to flow a current, a high voltage called a flyback voltage is generated between both ends of the exciting coil 18 in accordance with the degree of sharpness Q of the resonance circuit configured by the resonant capacitor 309 and the exciting coil 18. This voltage oscillates around the power-supply voltage, and converges to the power-supply voltage if the off-state is kept.

While the flyback voltage has large ringing and the voltage at the coil-side terminal of the second switching device 308 is negative, the reverse conducting diode is turned off, so that current flows into the exciting coil 18. During this period, the contact point between the exciting coil 18 and the second switching device 308 is clamped to 0 V. It is generally known that if the second switching device 308 is turned on during this period, the second switching device 308 can be turned on without being applied with a voltage. This process is called ZVS (zero voltage switching). According to such a driving method, it is possible to minimize a loss due to switching of the second switching device 308, and to realize efficient switching with low noise.

Current Detection Unit

Figure 13:
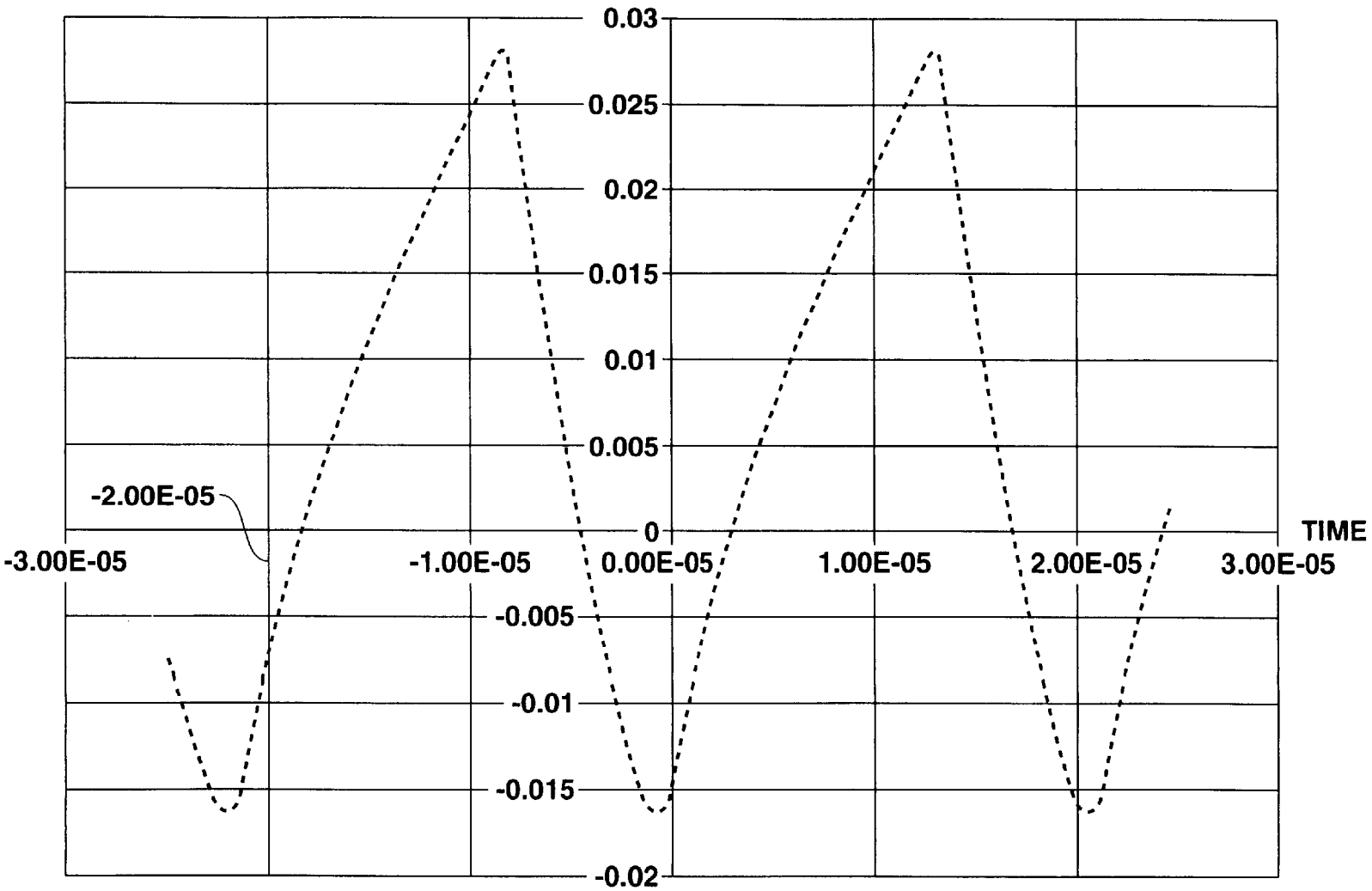
FIG. 13 is a diagram illustrating a current detection waveform in the fixing device of the image forming apparatus according to the first embodiment.

In the first embodiment, a description will be provided illustrating a case of using the current transformer 311 shown in FIGS. 1 and 11 (to be described later) for detecting the current flowing through the exciting coil 18 of the fixing device. FIG. 13 illustrates a detected waveform. The current transformer 311 is configured so as to detect a current from the emitter (the drain in the case of an FET) of the second switching device 308 to the negative terminal of the rectification circuit 304 and to a filtering capacitor (not shown) after the rectification circuit 304. The power-side current is flown to the one-turn side of the current transformer 311 having a 1:n winding, and voltage information is detected by a detection resistor provided at the n-turn side. After performing waveform shaping of the detection current by a filter circuit (a passive filter) 319 (see FIG. 11), a current-peak envelope is obtained by a peak holding circuit 320 (see FIG. 11) corresponding to a frequency of about 50 kHz.

Then, a current peak waveform containing a voltage ripple is obtained from a peak holding circuit 340 (see FIG. 11) corresponding to about 100 Hz which is connected after the peak holding circuit 320, and is used as a maximum-power control value. More specifically, a limiter operation using the output voltage as the power control peak value is performed. The ripple may be removed by a filter circuit 319 (see FIG. 11) using the output waveform as the limit value of the maximum output power, and the obtained voltage may be input to the feedback control circuit 315 shown in FIG. 1 as a more stable voltage corresponding to the peak current.

Temperature Control

In the first embodiment, a case of performing temperature control according to digital PID (Proportional plus Integral plus Derivative) control will be described.

Detection of the fixing temperature of the fixing device is performed by the thermistor 26. The thermistor 26 is disposed in pressure contact with the inner side of the sleeve at a portion downstream from the fixing nip, and measures the calorific value taken by paper, serving as a material to be heated, as a temperature change. A change in the resistance of the thermistor 26 is converted into a voltage, and the difference from the target temperature (the target voltage) is detected by comparing the voltage with a predetermined reference voltage. The on-time of the switching device is determined based on the result of the detection, and PWM (pulse width modulation) control is performed.

A PWM control circuit 323 includes a pair of constant-current-source circuits, i.e., an on-time control unit and an off-time control unit, a capacitor and a comparator. Time control is performed when the voltage exceeds a reference value as a result of charging the capacitor with a constant current from each of the constant-current-source circuits. In order to prevent an on-operation of each device other than the main switching device 307, the operation of the off-time control unit is stopped during an on-time, and the operation of the on-time control unit is stopped during an off-time. An on-time and an off-time whose width are controlled by an output FF (a steering flip-flop circuit) 329 within the PWM control circuit 323 are sequentially and repeatedly output. Although the comparator for the off-time can be adjusted, the off-time is made constant by not providing a feedback loop, and electric power is controlled by changing the input voltage for a comparator for an on-time (not shown).

Voltage Dependency of the Maximum Electric Power

Figure 14A:
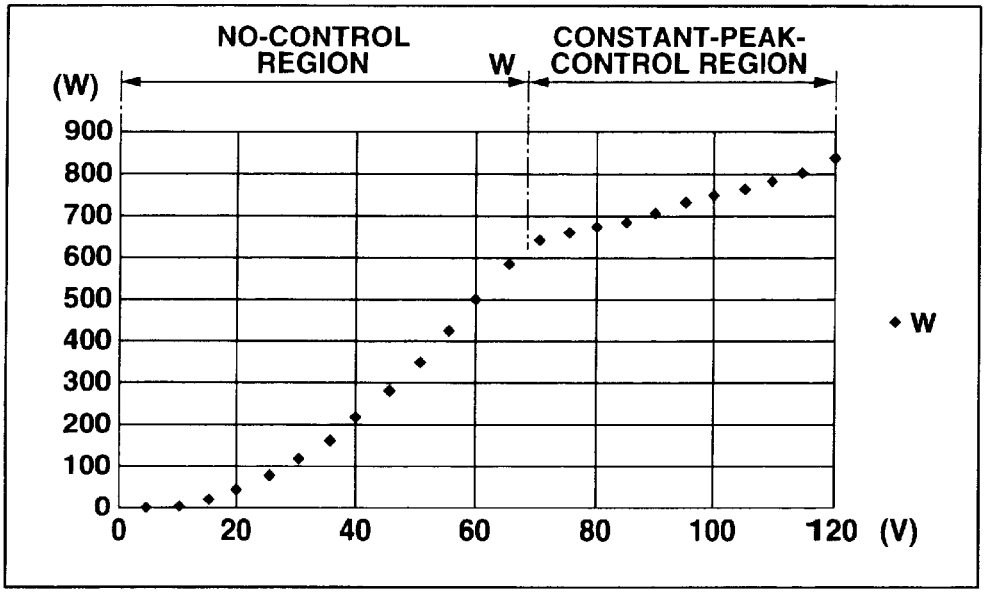
FIG. 14A is a diagram illustrating a result of experiment of the voltage dependency of the maximum power (the power-voltage characteristic in a non-control region and a constant-peak-control region) in the fixing device of the image forming apparatus according to the first embodiment.
Figure 14B:
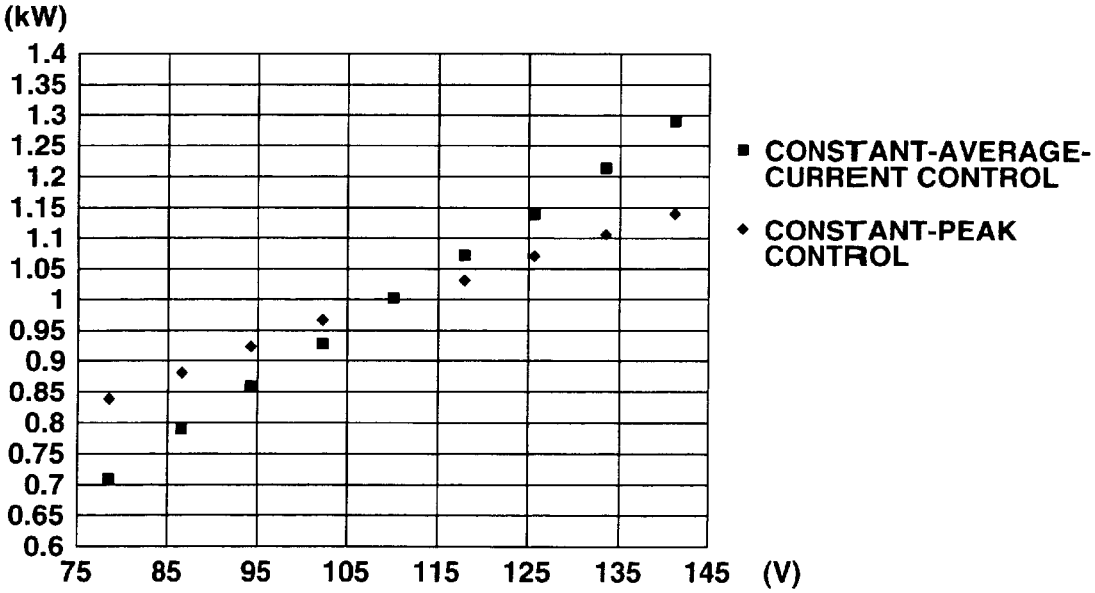
FIG. 14B is a diagram illustrating a result of experiment of the voltage dependency of the maximum power (the power-voltage characteristic in constant-average-current control and constant-peak control) in the fixing device of the image forming apparatus according to the first embodiment.

The voltage dependency of the maximum electric power will now be described. In a system in which current control is not performed at all, an output voltage varies in proportion to the square of an AC line voltage. On the other hand, in the configuration of the first embodiment in which the output voltage is limited by current detection, the output voltage can be linearly dependent on the line voltage. FIGS. 14A and 14B illustrate results of experiments in circuits for realizing the above-described two approaches. In FIG. 14A, a "no-control region" illustrates a result of experiment in the conventional approach, in which variations in electric power due to changes in the power supply voltage are large, and a "constant-peak-control region" illustrates a result of experiment according to the present invention, and indicates that variations in electric power due to changes in the power-supply voltage are small. In FIG. 14B, points indicated by square marks represent a result of experiment in the case of constant-average-current control, and points indicated by rhombic marks represent a result of experiment in the case of constant-peak control.

In order to control electric power by detecting current, the maximum value of the time of flow of current in the exciting coil 18 of the fixing unit 313, i.e., the on-time of the main switching device 307, is determined by the current flowing in the AC line and the electric power which can be supplied, and a control signal from the feedback control circuit 315 has a width within a range not exceeding that value. The minimum time may also be specified. For example, when the temperature of the fixing device of an image forming apparatus, such as a copier, a printer or the like, is low as when starting the image forming apparatus as soon as the working time starts, electric power is supplied with the width of an on-time close to the maximum time width. If the allowable electric power is assumed to be 1,100 W, electric power of 1,100 W is supplied according to current control within the range of the maximum on-time until temperature control operates from the turning-on of the power supply. Then, in accordance with temperature rise, electric power is controlled by limiting the on-time width according to a control method called PI control or PID control using a signal from the thermistor 26, serving as the temperature detector.

When the temperature becomes sufficiently high and the on-time width is shortened by temperature control, since the flyback voltage oscillates making the power-supply voltage a reference voltage, the flyback voltage cannot decrease to 0 V particularly when the power-supply voltage is high and the on-time width is short. As a result, ZVS cannot be realized. In such a case, the second switching device 308 is driven by comparing the circuit current detected by the current transformer 311 with a reference value. The second switching device 308 may continue to perform an ordinarily operation.

FIG. 5 is a diagram illustrating a configuration to generate an AC magnetic field by an exciting current in a state in which the exciting coil 18 is connected to the excitation circuit 27. The excitation circuit 27 is a high-frequency inverter device configured as shown in FIG. 1, and generates a high-frequency current from about 20 kHz to 100 kHz.

Figure 11:
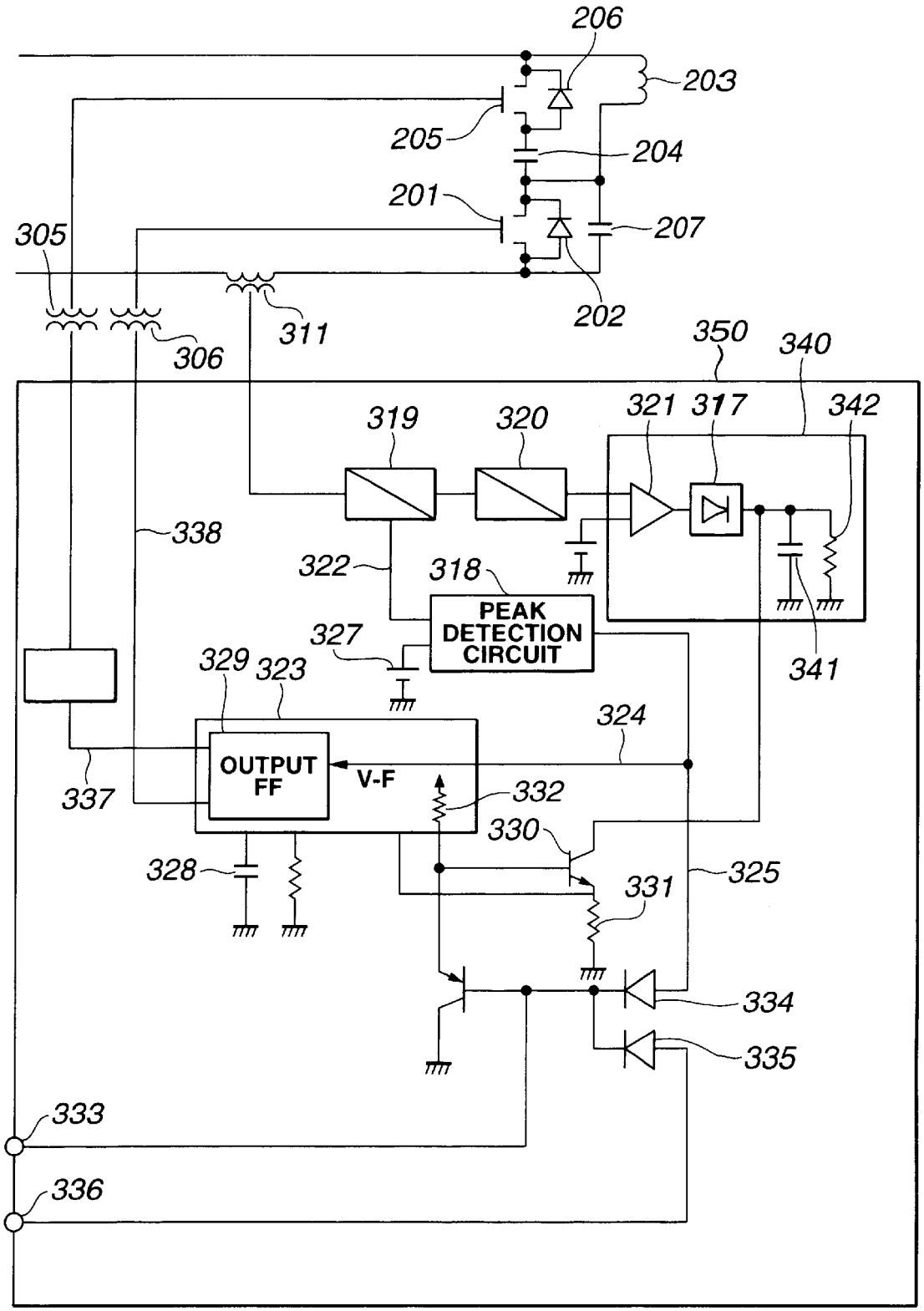
FIG. 11 is a block diagram illustrating the detailed configuration of an exciting circuit of the fixing device of the image forming apparatus according to the first embodiment.

FIG. 11 is a block diagram illustrating the detailed configuration of the excitation circuit 27 according to the first embodiment. The excitation circuit 27 includes a main switching device 201, a reverse conducting diode 202, an exciting coil 203, a resonant capacitor 204, a second switching device 205, a reverse conducting diode 206, a second resonant capacitor 207, gate control transformers 305 and 306, a current transformer 311, and a switching control circuit 350. The switching control circuit 350 includes a peak detection circuit 318, a filter circuit 319, a peak holding circuit 320, an operational amplifier 321, a rectification circuit 317, a capacitor 341, a resistor 342, a PWM control circuit 323, a DC power supply 327, a capacitor 328, a switching device 330, resistors 331 and 332, diodes 334 and 335, and the like.

The switching control circuit 350 shown in FIG. 11 corresponds to the driver circuit 315 shown in FIG. 1.

The operational amplifier 321, the rectification circuit 317, the capacitor 341 and the resistor 342 shown in FIG. 11 constitute a second peak holding circuit 340. The main switching device 201, the second switching device 205, the exciting coil 203, and the resonant capacitors 204 and 207 shown in FIG. 11 correspond to the main switching device 307, the second switching device 308, the exciting coil 18, and the resonant capacitors 309 and 310 shown in FIG. 1, respectively. Each of reference numerals 333 and 336 represents a terminal where an instruction when urgently stopping a fixing operation by the fixing device mounted in the image forming apparatus from the outside is input. There are also shown signal lines 322, 324, 325, 337 and 338.

The configuration and the operation of the above-described principal components will now be described in detail. A device such as a MOS(metal oxide semiconductor) FET or an IGBT is usually used as the main switching device 201. The configuration of the exciting coil 203 is as shown in the above-described FIGS. 6 and 7. The reverse conducting diode 206 is connected in series with the switching device 205. In an ordinary state, the second switching device 205 is in an open state. By turning on/off the main switching device 201 in this state, single voltage resonance is performed. The second switching device (a sub-resonance switching device) 205 may continue the above-described operation of turning on when the flyback voltage almost ends to raise and turning off when the flyback voltage almost drops, while the main switching device 201 is in an off-state.

The current flowing through the exciting coil 203 is detected by the current transformer 311. After rectifying the current by the rectification circuit 317, the rectified current is detected by the filter circuit 319. When the detected output is compared with a predetermined reference value by the peak detection circuit 318 and the output is detected to be a peak current equal to or larger than the reference value, a limiter operation of prohibiting output by fixing an output FF 329 of the PWM control circuit 323 to an off-state is performed. Such protection is performed when an abnormal current is detected, such as when a large current flows. After waveform shaping by the filter circuit 319, first, peak detection at a high frequency (several tens of kHz) is performed by the peak holding circuit 320, the peak current flowing through the AC line is detected by using the current waveform as the envelope of the period of the commercially available AC line obtained by connecting peaks, and the peak value corresponding to the period of the commercially available AC line is detected by the second peak holding circuit 340 constituted by the operational amplifier 321, the rectification circuit 317, the capacitor 341 and the resistor 342.

In the first embodiment, by controlling the maximum output value of the electric-power control circuit based on the detected peak current, the maximum value (maximum available electric power) of the width of electric power control is controlled based on the result of detection of the current of the AC line, so that the maximum electric power which can be supplied is hardly dependent on the AC line voltage.

Safety Device

The safety device is configured in the following manner. The circuitry is configured so that AC electric power is input to the power-supply input terminal 30 shown in FIG. 1, and is supplied to the rectification circuit 304 via the circuit breaker 302 and the relay 303 for protecting the device from eddy current. The exciting winding of the relay 303 is configured so as to be turned on by the 24 V power supply mounted in the image forming apparatus, and is excited via a thermoswitch contact for detecting the temperature of the fixing belt (film) 10 of the fixing device mounted in the image forming apparatus and disconnecting power supply to the fixing belt 10 if the detected temperature exceeds a specified temperature indicating that the fixing belt is abnormally heated. If a trouble occurs to abnormally raise the temperature of the fixing device, the power supply of the exciting circuit 27 is disconnected by the relay 303, in order to protect the fixing device from thermal runaway and secure safety.

As previously described, the switching frequency is about 100 kHz in the initial state. In the initial state, the gate pulse width =0, and the second switching device 205 (308) is not turned on at all. A gate pulse is output in response to a fixing start signal, and continues in accordance with a duty ratio determined by the current control circuit. At that time, if the limiter operates within ½ of the maximum on-time width, it is determined that an abnormal state has occurred and this fact is notified to the outside.

As described above, according to the first embodiment, since the fixing device for heating a material to be heated according to the magnetic-induction heating method includes the fixing unit 313 including the exciting coil 18, the fixing belt 10 and the thermistor 26, the current transformer 311 for detecting current flowing through the exciting coil 18, and the driver circuit 316 for performing, for example, control of limiting the maximum value of electric power supplied to the exciting coil 18 based on the current detection value of the current transformer 311, and control of stopping electric power supply to the exciting coil 18 when the detected temperature of the contact portion between the fixing belt 10 and the pressing roller 30 exceeds a specified temperature, the following functions and effects are provided.

That is, since control of the maximum electric power in the exciting coil 18 of the fixing device is performed using a signal from the current transformer 311, it is possible to maintain the maximum electric power when heating the metal fixing belt 10 according to the magnetic-induction-heating fixing method at a constant value, prevent a decrease in output due to a temperature rise, and realize higher-speed and more stable on-demand fixing. Since electric power supply to the exciting coil 18 is stopped when the detected temperature of the contact portion between the fixing belt 10 and the pressing roller 30 exceeds a specified temperature, and the fixing operation can be urgently stopped based on an external input, it is possible to secure safety of the fixing device from thermal runaway, and urgently stop the fixing operation in emergency.

Second Embodiment

Figure 15:
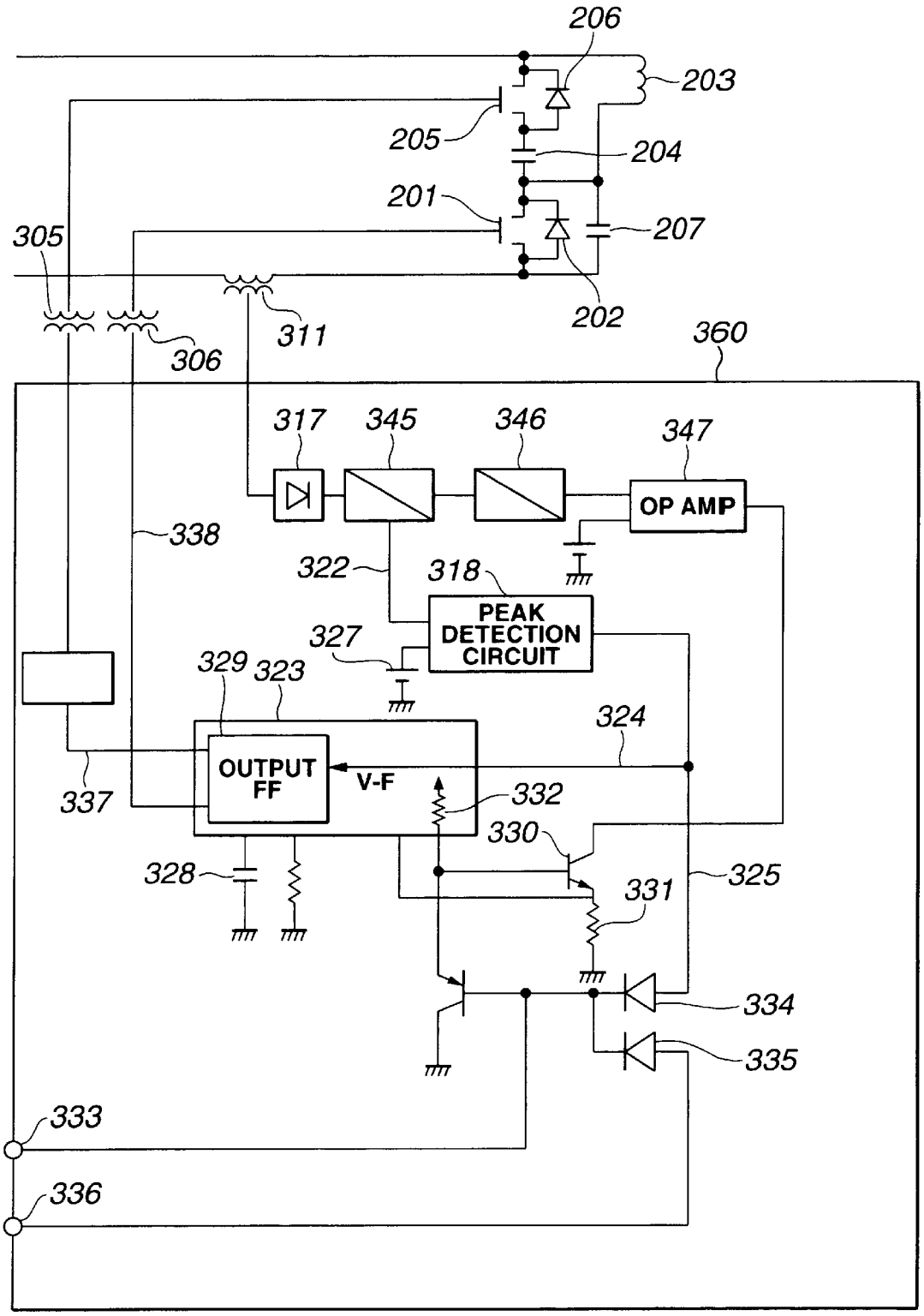
FIG. 15 is a block diagram illustrating the detailed configuration of an exciting circuit of a fixing device of an image forming apparatus according to a second embodiment of the present invention.

FIG. 15 is a block diagram illustrating the detailed configuration of an excitation circuit 27 according to a second embodiment of the present invention. The excitation circuit 27 according to the second embodiment includes a main switching device 201, a reverse conducting diode 202, an exciting coil 203, a resonant capacitor 204, a second switching device 205, a reverse conducting diode 206, a second resonant capacitor 207, gate control transformers 305 and 306, a current transformer 311, and a switching control circuit 360. The switching control circuit 360 includes a rectification circuit 317, a peak detection circuit 318, a first filter circuit 345, a second filter circuit 346, an operational amplifier 347, a PWM control circuit 323, a DC power supply 327, a capacitor 328, a switching device 330, resistors 331 and 332, diodes 334 and 335, and the like. A description will be omitted for the same components as those shown in FIG. 11 in the first embodiment.

The switching control circuit 360 shown in FIG. 15 corresponds to the driver circuit 315 shown in FIG. 1. The main switching device 201, the second switching device 205, the exciting coil 203, the resonant capacitor 204 and the second resonant capacitor 207 shown in FIG. 15 correspond to the main switching device 307, the second switching device 308, the exciting coil 18, the resonant capacitor 309 and the second resonant capacitor 310 shown in FIG. 1, respectively. Each of reference numerals 333 and 336 represents a terminal where an instruction when urgently stopping a fixing operation by the fixing device mounted in the image forming apparatus from the outside is input. There are also shown signal lines 322, 324, 325, 337 and 338.

The configuration and the operation of the above-described principal components will now be described in detail. The current flowing through the exciting coil 203 is detected by the current transformer 311. After rectifying the current by the rectification circuit 317, the rectified current is detected by the first filter circuit 345. When the detected output is compared with a predetermined reference value by the peak detection circuit 318 and the output is detected to be a peak current equal to or larger than the reference value, a limiter operation of prohibiting output by fixing an output FF 329 of the PWM control circuit 323 to an off-state is performed. Such protection is performed when an abnormal current is detected, such as when a large current flows.

After waveform shaping by the first filter circuit 345, filtering at a lower frequency is performed by the second filter circuit 346, the obtained current is detected as an average current flowing through the AC line, and a voltage corresponding to the average current value is output from the operational amplifier 347. By using the output voltage as a control power-supply voltage for the current control circuit, the maximum value (maximum available electric power) of the width of electric power control is controlled based on the result of detection of the current of the AC line, so that the maximum electric power which can be supplied is hardly dependent on the AC line voltage.

As previously described, the switching frequency is about 100 kHz in the initial state. In the initial state, the gate pulse width =0, and the second switching device 205 (308) is not turned on at all. The duty ratio is increased according to duty-ratio control. At that time, if the limiter operates within ½ of the maximum on-time width, it is determined that an abnormal state has occurred and this fact is notified to the outside.

As described above, according to the second embodiment, as in the first embodiment, since control of the maximum electric power in the exciting coil 18 of the fixing device is performed using a signal from the current transformer 311, it is possible to maintain the maximum electric power when heating the metal fixing belt 10 according to the magnetic-induction-heating fixing method at a constant value, prevent a decrease in output due to a temperature rise, and realize higher-speed and more stable on-demand fixing. Furthermore, it is possible to secure safety of the fixing device from thermal runaway, and urgently stop the fixing operation in emergency.

Third Embodiment

Figure 16:
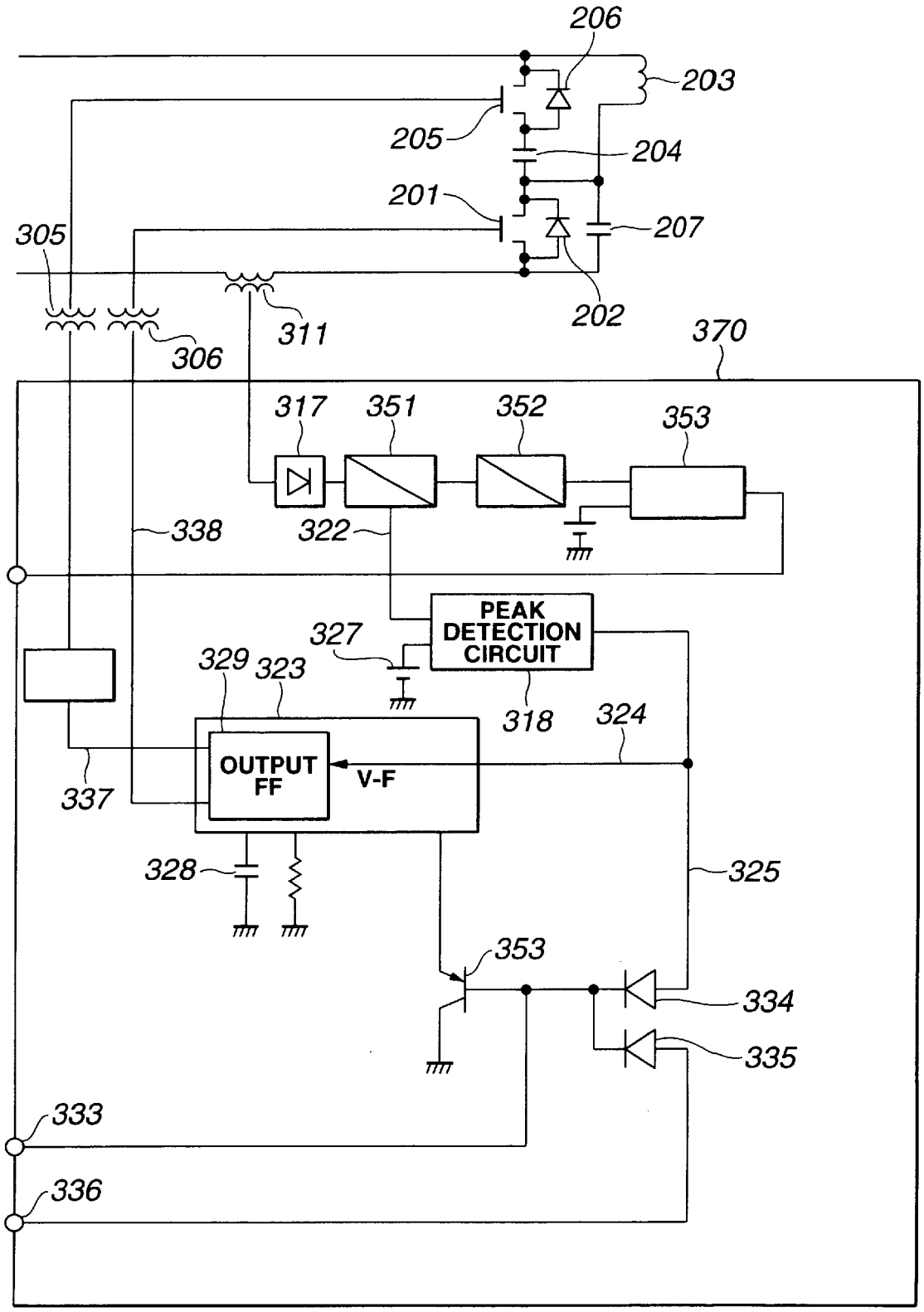
FIG. 16 is a block diagram illustrating the detailed configuration of an exciting circuit of a fixing device of an image forming apparatus according to a third embodiment of the present invention.

FIG. 16 is a block diagram illustrating the detailed configuration of an excitation circuit 27 according to a third embodiment of the present invention. The excitation circuit 27 according the third embodiment includes a main switching device 201, a reverse conducting diode 202, an exciting coil 203, a resonant capacitor 204, a second switching device 205, a reverse conducting diode 206, a second resonant capacitor 207, gate control transformers 305 and 306, a current transformer 311, and a switching control circuit 370. The switching control circuit 370 includes a rectification circuit 317, a peak detection circuit 318, a first filter circuit 351, a first peak holding circuit 352, a second peak holding circuit 352, a PWM control circuit 323, a DC power supply 327, a capacitor 328, a resistor 332, diodes 334 and 335, a switching device 353, and the like. A description will be omitted for the same components as those shown in FIG. 11 in the first embodiment.

The switching control circuit 370 shown in FIG. 16 corresponds to the driver circuit 315 shown in FIG. 1. The main switching device 201, the second switching device 205, the exciting coil 203, the resonant capacitor 204 and the second resonant capacitor 207 shown in FIG. 16 correspond to the main switching device 307, the second switching device 308, the exciting coil 18, the resonant capacitor 309 and the second resonant capacitor 310 shown in FIG. 1, respectively. Each of reference numerals 333 and 336 represents a terminal where an instruction when urgently stopping a fixing operation by the fixing device mounted in the image forming apparatus from the outside is input. There are also shown signal lines 322, 324, 325, 337 and 338.

The configurations and the operations of the above-described principal components will now be described in detail. Peak-current information obtained after passing through the first peak holding circuit 352 and the second peak holding circuit 353 is transmitted to the feedback control circuit 315 (shown in FIG. 1) and is converted into a digital signal by an A/D converter incorporated in the feedback control circuit 315. The resultant signal is input to a PID control unit incorporated in the feedback control circuit 315 for performing temperature control as peak-current information, and maximum electric power which can be supplied is controlled so that the maximum electric power calculated from that information does not exceed a constant value. The result of calculation is reflected as gate-on-time information to be output to the gate pulse signal, and is input to the switching control circuit 370 as a voltage output or a PWM output from a D/A converter, supplied from the a CPU incorporated in the feedback control circuit 315.

When the result of calculation exceeds the maximum electric power, the maximum electric power calculated from the peak-current information is output, so that smooth control can be performed by performing feedback of the actually output power width in stead of the result of calculation, as data for PID control. If it is necessary to perform a current limiter operation as a safety circuit different from a control loop for each wave, the approach of the above-described first embodiment of performing feedback for the hardware may be adopted.

As described above, according to the third embodiment, as in the first embodiment, since control of the maximum electric power in the exciting coil 18 of the fixing device is performed using a signal from the current transformer 311, it is possible to maintain the maximum electric power when heating the metal fixing belt 10 according to the magnetic-induction-heating fixing method at a constant value, prevent a decrease in output due to a temperature rise, and realize higher-speed and more stable on-demand fixing. Furthermore, it is possible to secure safety of the fixing device from thermal runaway, and urgently stop the fixing operation in emergency.

Other Embodiments

In the foregoing first through third embodiments of the present invention, the type of the image forming apparatus where the fixing device of the invention is mounted has not particularly been mentioned. However, the present invention may be applied to various types of image forming apparatuses, such as copiers, printers and the like for performing image formation by fixing an unfixed image on a material to be heated as a permanent fixed image.

In the foregoing first through third embodiments of the present invention, configurations other than the image forming apparatus where the fixing device of the invention is mounted have not been particularly mentioned. However, the present invention may also be applied to a system comprising a plurality of apparatuses, such as an image forming apparatus and the like, or to an apparatus comprising a single unit, such as an image forming apparatus.

The individual components shown in outline or designated by blocks in the drawings are all well known in the heating device, image forming apparatus and electric-power control method arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A heating device for heating a material to be heated according to a magnetic-induction heating method, said device comprising:

magnetic-field generation means for generating a magnetic field;

an electromagnetic-induction heating member for performing electromagnetic-induction heating by the magnetic field generated by said magnetic-field generation means;

current detection means for detecting a current flowing in said magnetic-field generation means;

electric power supply means for supplying said magnetic-field generation means with high-frequency electric power; and control means for controlling an operation of said electric power supply means, based on a result of detection of said current detection means, wherein said control means comprises current-peak hold means for holding a peak value of the current detected by said current detection means, and controls the operation of said electric power supply means based on the peak value of the current held by said current-peak hold means.

2. A heating device according to claim 1, further comprising temperature detection means for detecting a temperature at a portion near a contact portion between said electromagnetic-induction heating member and the material to be heated, wherein said control means controls the operation of said electric power supply means so that the temperature detected by said temperature detection means equals a specified temperature.

3. A heating device according to claim 1, further comprising comparing means for comparing a current detected by said current detection means with a predetermined value, wherein said control means controls the operation of said electric power supply means based on the result of said comparing means so as to limit a maximum current flowing to said magnetic-field generation means.

4. A heating device according to claim 1, wherein said control means controls the operation of said electric power supply means so that a maximum peak current held by said current-peak hold means is constant independent of a voltage of an alternative power source.

5. A heating device according to claim 1, further comprising urgent stop means for urgently stopping a heating operation by said electromagnetic-induction heating means, based on an external input.

6. A heating device according to claim 1, wherein said heating device can be mounted in a copier or a printer for performing image formation by heating and fixing an unfixed image on a material to be heated as a permanent fixed image, using a resonance-type power supply.

7. An image forming apparatus comprising a heating device for heating a recording material by heat generated according to a magnetic-induction heating method, said heating device comprising:

magnetic-field generation means for generating a magnetic field;

electromagnetic-induction heating means for heating the recording material by performing electromagnetic-induction heating by the magnetic field generated by said magnetic-field generation means;

current detection means for detecting a current flowing to said magnetic-field generation means;

electric power supply means for supplying said magnetic-field generation means with high-frequency electric power; and control means for controlling an operation of said electric power supply means, based on a result of detection of said current detection means, wherein said control means comprises current-peak extraction means for holding a peak value of the current detected by said current detection means, and controls the operation of said electric power supply means based on the peak value of the current held by said current-peak hold means.

8. An image forming apparatus according to claim 7, further comprising comparing means for comparing a current detected by said current detection means with a predetermined value, wherein said control means controls the operation of said electric power supply means based on the result of said comparing means so as to limit a maximum current flowing to said magnet-field generation means.

9. An image forming apparatus according to claim 7, wherein said heating device further comprises temperature detection means for detecting a temperature at a contact portion between said electromagnetic-induction heating means and said pressing means, wherein said control means controls the operation of said electric power supply means so that the temperature detected by said temperature detection means equals a specified temperature.

10. An image forming apparatus according to claim 7, wherein said control means controls the operation of said electric power supply means so that a maximum peak current held by said current-peak hold means is constant independent of a voltage of an alternative power source.

11. An image forming apparatus according to claim 7, wherein said heating device further comprises frequency filter means for filtering a voltage signal output from said current detection means, comparing means for comparing a current detected by said current detection means with a predetermined value, wherein said control means controls the operation of said electric power supply means based on the result of said comparing means so as to limit a maximum current flowing to said magnetic-field generation means, and controls the operation of said electric power supply means so that a maximum peak current held by said current peak hold means is constant independent of a voltage of an alternative power source.

12. An image forming apparatus according to claim 7 wherein said heating device further comprises urgent stop means for urgently stopping a heating operation by said electromagnetic-induction heating means, based on an external input.

13. An image forming apparatus according to claim 7, wherein said image forming apparatus comprises a copier or a printer for performing image formation by heating and fixing an unfixed image on a material to be heated as a permanent fixed image, using a resonance-type power supply.

14. An electric-power control method applied to a heating device for heating a material to be heated according to a magnetic-induction heating method, the heating device including magnetic-field generation means for generating a magnetic field, electric power supply means for supplying said magnetic-field generation means with high-frequency electric power, electromagnetic-induction heating means for heating the material to be heated by performing electromagnetic-induction heating by the magnetic field generated by the magnetic-field generation means, said method comprising the steps of:

detecting a current flowing to said magnetic-field generation means; and controlling an operation of said electric power supply means, based on a result of detection in said current detection step, wherein said control step comprises a current-peak hold step of holding a peak value of the current detected by said current detection step, and controls electric power supplied to the magnetic-field generation means based on the peak value of the current held by said current-peak hold means.

15. An electric-power control method according to claim 14, further comprising a comparing step of comparing a current detected by said current detection step with a predetermined value, wherein in said control step the operation of said electric power supply means is controlled based on the result of said comparing step so as to limit a maximum current flowing to said magnetic-field generation means.

16. An electric-power control method according to claim 14, further comprising a temperature detection step of detecting a temperature at a contact portion between the electromagnetic-induction heating means and pressing means, said pressing means for grasping the material to be heated, wherein in said control step, the operation of said electric power supply means is controlled so that the temperature detected by said temperature detection means equals a specified temperature.

17. An electric-power control method according to claim 14, wherein in said control step, the operation of said electric power supply means is controlled so that a maximum peak current held by said current-peak hold means is constant independent of a voltage of an alternative power source.

18. An electric-power control method according to claim 14, further comprising a frequency filtering step of filtering a voltage signal output in said current detection step, comparing step of comparing a current detected by said current detection step with a predetermined value, wherein in said control step, the operation of said electric power supply means is controlled based on the result of said comparing step so as to limit a maximum current flowing to said magnet-field generation means, and the operation of said electric power supply means is controlled so that a maximum peak current held by said current-peak hold means is constant independent of a voltage of an alternative power source.

19. An electric-power control method according to claim 14, further comprising an urgent stop step of urgently stopping a heating operation by the electromagnetic-induction heating means, based on an external input.

20. An electric-power control method according to claim 14, wherein said electric-power control method is applicable to a copier or a printer for performing image formation by heating and fixing an unfixed image on a material to be heated as a permanent fixed image, using a resonance-type power supply.

* * * * *

UNITED STATES PATENT AND TRADEMARK OFFICE

CERTIFICATE OF CORRECTION

PATENT NO. : 6,359,269 B1
DATED : March 19, 2001
INVENTOR(S) : Minoru Hayasaki et al.

It is certified that error appears in the above-identified patent and that said Letters Patent is hereby corrected as shown below:

Column 4,
Line 16, "portion P" should read -- portion --.

Column 7,
Line 55, "in," should be deleted.

Column 8,
Line 58, "perfored" should read -- performed --.

Column 10,
Line 45, "containing" should read -- contains --.
Line 66, "(polytetrafluroethylene)" should read -- (polytetrafluoroethylene) --.

Column 12,
Line 7, "occurs" should read -- occurring --.
Line 37, "$8x10^{-}$" should read -- $8x10^{-4}$- --.
Line 38, "$_4$-$1.5x10^{-3}$ cal/cm.sec.deg." should read -- $1.5x10^{-3}$ cal/cm.sec.deg. --.
Line 45, "the-thickness" should read -- the thickness --.

Column 15,
Line 14, "width" should read -- widths --.

Column 16,
Line 6, "ordinarily" should read -- ordinary --.

Column 18,
Line 31, "circuit 315" should read -- circuit 316 --.

Column 19,
Line 25, "the" should read -- to the --.
Line 40, "circuit 315" should read -- circuit 316 --.

Column 20,
Line 1, "the" should be deleted.
Line 6, "in stead" should read -- instead --.

UNITED STATES PATENT AND TRADEMARK OFFICE

CERTIFICATE OF CORRECTION

PATENT NO. : 6,359,269 B1
DATED : March 19, 2001
INVENTOR(S) : Minoru Hayasaki et al.

It is certified that error appears in the above-identified patent and that said Letters Patent is hereby corrected as shown below:

Column 22,
Line 6, "magnet-field" should read -- magnetic-field --.
Line 11, "said pressing means," should read -- a pressing means --.
Line 23, "comparing" (1st occurrence) should read -- and comparing --.
Line 32, "current peak" should read -- current-peak --.
Line 52, "power," should read -- power, and --.

Column 24,
Line 1, "com-" should read -- and a com- --.

Signed and Sealed this

Twenty-seventh Day of August, 2002

*Attest:*

*Attesting Officer*

JAMES E. ROGAN
*Director of the United States Patent and Trademark Office*